US011291967B2

(12) United States Patent
Melton et al.

(10) Patent No.: US 11,291,967 B2
(45) Date of Patent: Apr. 5, 2022

(54) SILICA DUST MITIGATION AND RECIRCULATION SYSTEM AND ASSOCIATED METHODS

(71) Applicant: Cisco Logistics, LLC, Cisco, TX (US)

(72) Inventors: Kolby Melton, Midland, TX (US); Sean Mosher, Eastland, TX (US)

(73) Assignee: CISCO LOGISTICS, LLC, Cisco, TX (US)

( * ) Notice: Subject to any disclaimer, the term of this patent is extended or adjusted under 35 U.S.C. 154(b) by 294 days.

(21) Appl. No.: 16/811,167

(22) Filed: Mar. 6, 2020

(65) Prior Publication Data

US 2020/0298192 A1 Sep. 24, 2020

Related U.S. Application Data

(60) Provisional application No. 62/819,721, filed on Mar. 18, 2019.

(51) Int. Cl.
*B01F 23/50* (2022.01)
*B01F 35/00* (2022.01)
(Continued)

(52) U.S. Cl.
CPC ..... *B01F 35/184* (2022.01); *B01F 23/59* (2022.01); *B01F 35/187* (2022.01);
(Continued)

(58) Field of Classification Search
CPC ..... B01F 35/184; B01F 35/71731; B01F 35/187; B01F 23/59; B01F 35/1775; B01F 2101/49; E21B 43/267
See application file for complete search history.

(56) References Cited

U.S. PATENT DOCUMENTS 5,415,512 A 5/1995 Buchfink
6,065,922 A 5/2000 Kato et al.
(Continued)

FOREIGN PATENT DOCUMENTS

CA 2831525 1/2014
CN 204411988 6/2015
(Continued)

*Primary Examiner* — Anshu Bhatia

(74) *Attorney, Agent, or Firm* — Worble Bond Dickinson (US) LLP

(57) ABSTRACT

The present disclosure includes embodiments of a recirculation system and methods for mitigating release of silica dust at a hydrocarbon well site. The embodiments of the recirculation system may include a blender hopper, one or more proppant silos, a footed hood, a conveyor, one or more amplifiers, one or more compressed air sources, one or more vacuum hoses, an augur, and a blender. In one or more embodiments, the methods of recirculating silica dust to mitigate the release of silica dust includes conveying sand proppant on a conveyor from the one or more proppant silos to a blender hopper, directing sand proppant from the conveyor into the blender hopper, supplying compressed air to one or more amplifiers, directing sand proppant from the blender hopper to a blender via an augur, and adjusting the extent of at least one of the two or more leg segments and the leg adjustment arrangement.

28 Claims, 21 Drawing Sheets

(51) Int. Cl.
*B01F 35/71* (2022.01)
*E21B 43/267* (2006.01)
*B01F 101/49* (2022.01)

(52) U.S. Cl.
CPC .. *B01F 35/71731* (2022.01); *B01F 35/71775* (2022.01); *B01F 2101/49* (2022.01); *E21B 43/267* (2013.01)

(56) References Cited

U.S. PATENT DOCUMENTS

| | | | | |
|---|---|---|---|---|
| 6,491,070 | B1 * | 12/2002 | Espina Frutos | B65G 69/182 141/54 |
| 2008/0063495 | A1 | 3/2008 | Niedworok | |
| 2009/0156112 | A1 | 6/2009 | Kubota et al. | |
| 2013/0233439 | A1 | 9/2013 | Stutzman et al. | |
| 2013/0309052 | A1 | 11/2013 | Luharuka et al. | |
| 2014/0115821 | A1 * | 5/2014 | Beaton | B08B 15/007 15/415.1 |
| 2015/0107822 | A1 | 4/2015 | Tudor | |
| 2015/0360188 | A1 * | 12/2015 | Green | B01F 35/2218 366/147 |
| 2015/0360856 | A1 | 12/2015 | Oren et al. | |
| 2016/0059168 | A1 | 3/2016 | Bataille et al. | |
| 2017/0144848 | A1 | 5/2017 | Koehler et al. | |
| 2017/0190523 | A1 | 7/2017 | Oren et al. | |
| 2017/0291780 | A1 | 10/2017 | Sherwood et al. | |

FOREIGN PATENT DOCUMENTS

| | | |
|---|---|---|
| WO | 2018038721 | 3/2018 |
| WO | 2018038723 | 3/2018 |

* cited by examiner

SILICA DUST MITIGATION AND RECIRCULATION SYSTEM AND ASSOCIATED METHODS

RELATED APPLICATION

The present application is a non-provisional application which claims priority to, and the benefit of U.S. Provisional Application No. 62/819,721, titled "SILICA DUST MITIGATION AND RECIRCULATION SYSTEM AND ASSOCIATED METHODS," filed Mar. 18, 2019, which is incorporated herein by reference in its entirety.

FIELD OF INVENTION

The present disclosure relates generally to the field of hydrocarbon fracturing operations. More specifically, the present disclosure relates to embodiments of systems, apparatuses, and associated methods to recirculate silica dust during hydrocarbon fracturing operations at a hydrocarbon well site.

BACKGROUND

In enhanced hydrocarbon oil and gas recovery, a well completion technique known as hydraulic fracturing is commonly used to stimulate at a desired target zone. The technique injects a large volume of pressurized proppant sand and fluid mixtures into the desired target zone through an either horizontal or a vertical encased well bore to produce a network of fractures especially in tight rock formations with low permeability. The proppant sand holds open the fractures in the tight rock formations once the pressure from the pumped fluid mixtures releases, allowing the hydrocarbon oil and gas to flow out of the tight rock formations and into the well bore. The most commonly used proppant sand in hydraulic fracturing is frac sand which is composed by high-purity silica.

As field operators handle frac sand in various stages of hydraulic fracturing operations at the hydrocarbon well site, highly concentrated respirable tiny crystalline silica dust particles are produced and potentially released into the surrounding. As such, field operators who are positioned near the location where the frac sand is conveyed on a conveyor from a source to a blender before the frac sand is injected into the well bore, for example, are highly exposed to the released tiny crystalline silica dust particles.

According to numerous health studies, these tiny crystalline silica dust particles may risk causing lung irritation when inhaled in the lungs by the field operators. Although the need for controlling and mitigating the release of silica dust into the air to reduce exposure of the silica dust to the field operators, for example, has been recognized by others, effective systems to enhance field operations remains a technical and environmental problem at a hydrocarbon well site.

SUMMARY

Thus, Applicants have recognized that there still remains a need for an effective system and related methods which may be used to mitigate the release of silica dust into the surrounding during hydraulic fracturing operations in ways that enhance field operations.

Applicants recognized the problems noted above herein and conceived and developed embodiments of a silica dust mitigation and recirculation system and associated methods, according to the present disclosure, for mitigating the release of silica dust into the surrounding and recirculating collected dust for continued use in field operations, namely during hydraulic fracturing operations at a hydrocarbon well site.

Such an embodiment of a system, for example, may provide a mechanism to control the exposure of silica dust and mitigate the release of the respirable silica dust into the surrounding. The embodiment of the present disclosure may limit the exposure of the field operators to respirable silica dust during the handling of frac sand at the hydrocarbon well site.

In one disclosed embodiment, a silica dust mitigation and recirculation system for a hydrocarbon well site, for example, may include a blender hopper positioned to receive sand proppant, proppant silos positioned at a selected distance from the blender hopper at the hydrocarbon well site to store sand proppant therein, and a footed hood to overlie the blender hopper. The embodiment of the footed hood, for example, may include a main hood portion having outlets to provide a fluid outlet path from the footed hood to the proppant silos.

The embodiment of a silica dust mitigation and recirculation system may also include a conveyor having a proximal end portion and a distal end portion. In yet disclosed embodiments, the silica dust mitigation and recirculation system may further include, for example, air amplifiers connected to the main hood portion of the footed hood to amplify air in the footed hood. The supplied compressed air may enhance drawing of air and generated silica dust in regions underlying the footed hood and overlying the blender hopper by vacuum pressure through the outlets of the main hood portion of the footed hood.

In one embodiment, the silica dust mitigation and recirculation system may include compressed air sources positioned to supply compressed air to the air amplifiers.

In another embodiment the silica dust mitigation and recirculation system may further include vacuum hoses in fluid communication with the outlets of the main hood portion of the footed hood. The embodiment of the vacuum hoses may extend away therefrom to the sand proppant silos to provide a path for the generated silica dust from the footed hood to sand proppant silos. In one embodiment, the generated silica dust may be removed from regions overlying the blender hopper and fluidly recirculated to the sand proppant silos for storage therein and to be supplied once again for conveyance on the conveyor.

According to an embodiment of the present disclosure, the main hood portion may further include a main hood body having a shielded curtain portion positioned adjacent the distal end portion of the conveyor from which sand proppant is being conveyed into the blender hopper.

As will be understood by those skilled in the art, the shielded curtain portion may be transparent or translucent to allow an operator to view the interior of the footed hood during operation. The shielded curtain portion may be positioned as a cover for the opening of the main hood body to retain air and the silica within the footed hood.

The shielded curtain portion may include a plurality of vertically hanging strips. An embodiment of the plurality of vertically hanging strips may be formed of a flexible material. Each of the vertically hanging strips may have a pair of horizontal short edges separated by a selected vertical dimension. The selected vertical dimension may define a length of each of the vertically hanging strips to span the opening of the main hood body of the footed hood. Each of the vertically hanging strips may further have a pair of vertical long edges separated by a selected horizontal dimension. The selected horizontal dimension may define a width of each of the vertically hanging strips. The length and the width defining an area of each of the vertically hanging strips.

The pair of horizontal short edges of each of the vertically hanging strips may include a proximal short edge portion and a distal short edge portion. The proximal short edge portion may be suspended from adjacent an edge of the main hood portion. The distal short edge portion may be terminated adjacent a lower region of the main hood body of the footed hood to substantially cover height of the opening. Each of the vertically hanging strips may overlap one another to partially cover the opening into which the end of the conveyor enters the main hood body of the footed hood.

In one embodiment, the footed hood may further include support legs connected to and extending downwardly from lower peripheries of the main hood portion. The footed hood may also include, for example, feet which may be connected to a respective one of the support legs to enhance support for the footed hood on a support surface at the hydrocarbon well site.

The embodiment of the vacuum hoses may be connected to a sand silo filter arrangement positioned in an upper portion of each of the sand proppant silos to enhance filtering of the silica dust.

In another embodiment, each of the support legs of the footed hood may further include two or more leg segments and a leg adjustment arrangement positioned to adjust the extent of at least one of the two or more support leg segments to thereby adjust the overall vertical extent of each of the support legs and thereby, in turn, to adjust overall height of the footed hood to a selected height so that the main hood portion overlies the blender hopper at a desired elevational location.

In yet another disclosed embodiment, a method of mitigating and recirculating silica dust at a hydrocarbon well site may involve, for example, conveying sand proppant on a conveyor from proppant silos to a blender hopper through a footed hood positioned to overlie the blender hopper.

In another disclosed embodiment, a method of mitigating and recirculating silica dust at a hydrocarbon well site may also involve directing sand proppant from the conveyor into the blender hopper through an opening adjacent the lower portion of the footed hood to unload sand proppant from the conveyor into the blender hopper. The unloading of sand proppant may generate silica dust in regions underlying the footed hood and overlying the blender hopper.

In a further disclosed embodiment, a method of mitigating and recirculating silica dust at a hydrocarbon well site may further involve supplying compressed air to air amplifiers connected to a main hood portion of the footed hood to create a vacuum in the main hood portion of the footed hood. The air and the generated silica dust being drawn under vacuum pressure from the regions underlying the footed hood and overlying the blender hopper and recirculated from outlets of the footed hood to the proppant silos via vacuum hoses.

An embodiment of a method of mitigating and recirculating silica dust at a hydrocarbon well site may involve adjusting the extent of at least one of the two leg segments and the leg adjustment arrangement.

In another embodiment, a method of mitigating and recirculating silica dust at a hydrocarbon well site may involve conveying sand proppant on a conveyor from proppant silos to a blender hopper positioned at the hydrocarbon well site through a dust hood positioned to overlie the blender hopper.

A method of mitigating and recirculating silica dust at a hydrocarbon well site, for example, may further involve directing sand proppant from the conveyor into the blender hopper through an opening adjacent the lower portion of the dust hood to unload sand proppant from the conveyor into the blender hopper. The dust hood may have outlets to provide a fluid outlet path from the dust hood to the proppant silos. The unloading of sand proppant may generate silica dust in regions underlying the dust hood and overlying the blender hopper.

In another embodiment, a method of mitigating and recirculating silica dust at a hydrocarbon well site may involve supplying compressed air to air amplifiers connected to the dust hood from compressed air sources thereby to create a vacuum in the dust hood. The air and the generated silica dust being drawn under vacuum pressure from the regions underlying the dust hood and overlying the blender hopper and recirculated from the outlets of the dust hood to the proppant silos via vacuum hoses.

BRIEF DESCRIPTION OF DRAWINGS

The foregoing aspects, features, and advantages of the present disclosure will be further appreciated when considered with reference to the following drawings.

DETAILED DESCRIPTION OF THE DISCLOSURE

The foregoing aspects, features, and advantages of the present disclosure will be further appreciated when considered with reference to the following description of the following embodiments and accompanying drawings. In describing the following embodiments of the disclosure illustrated in the appended drawings, specific terminology will be used for the sake of clarity. The disclosure, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Figure 1:
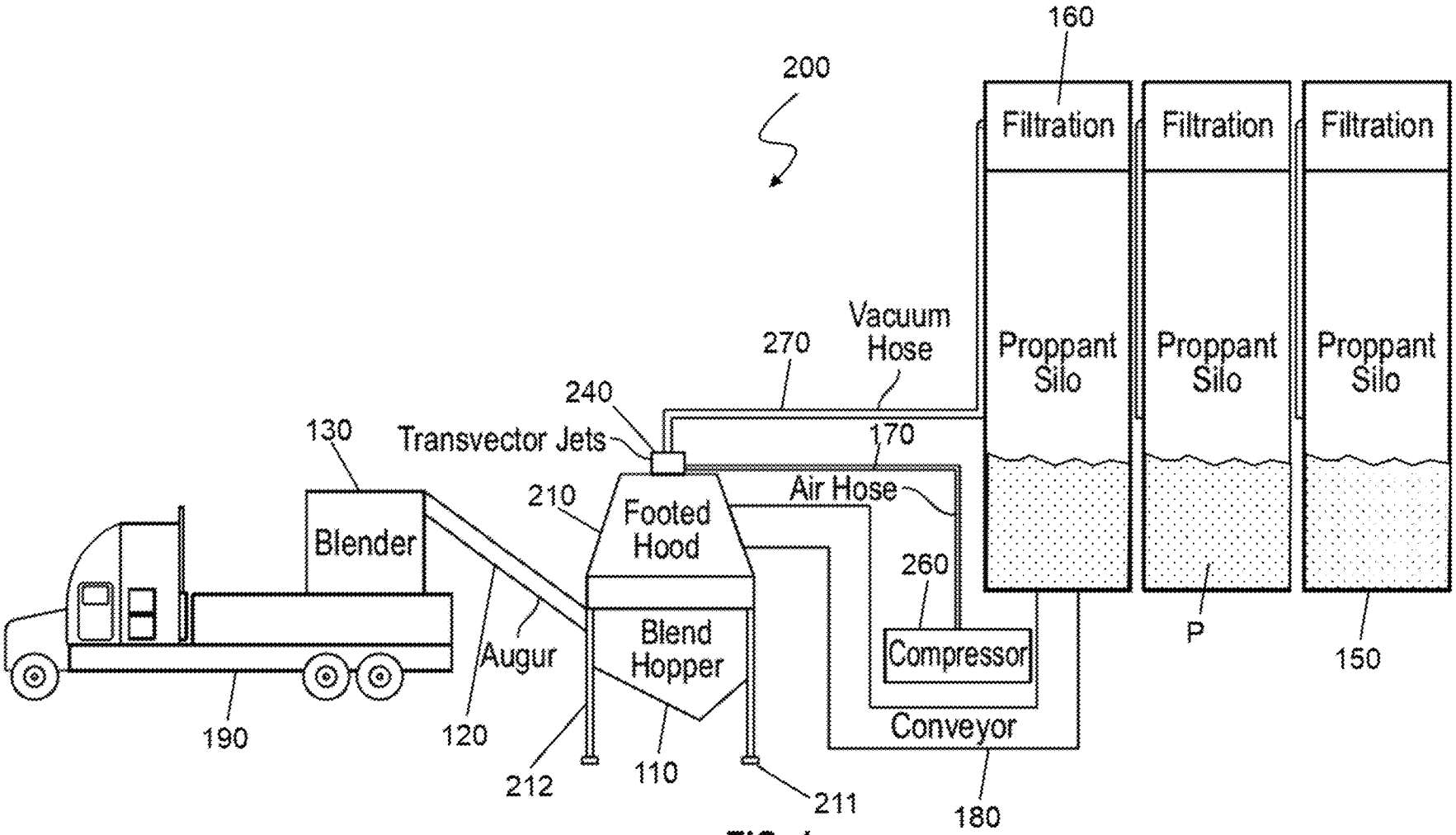
FIG. 1 is an embodiment of a schematic diagram of a re-circulatory silica dust system according to an embodiment of the present disclosure.
Figure 2:
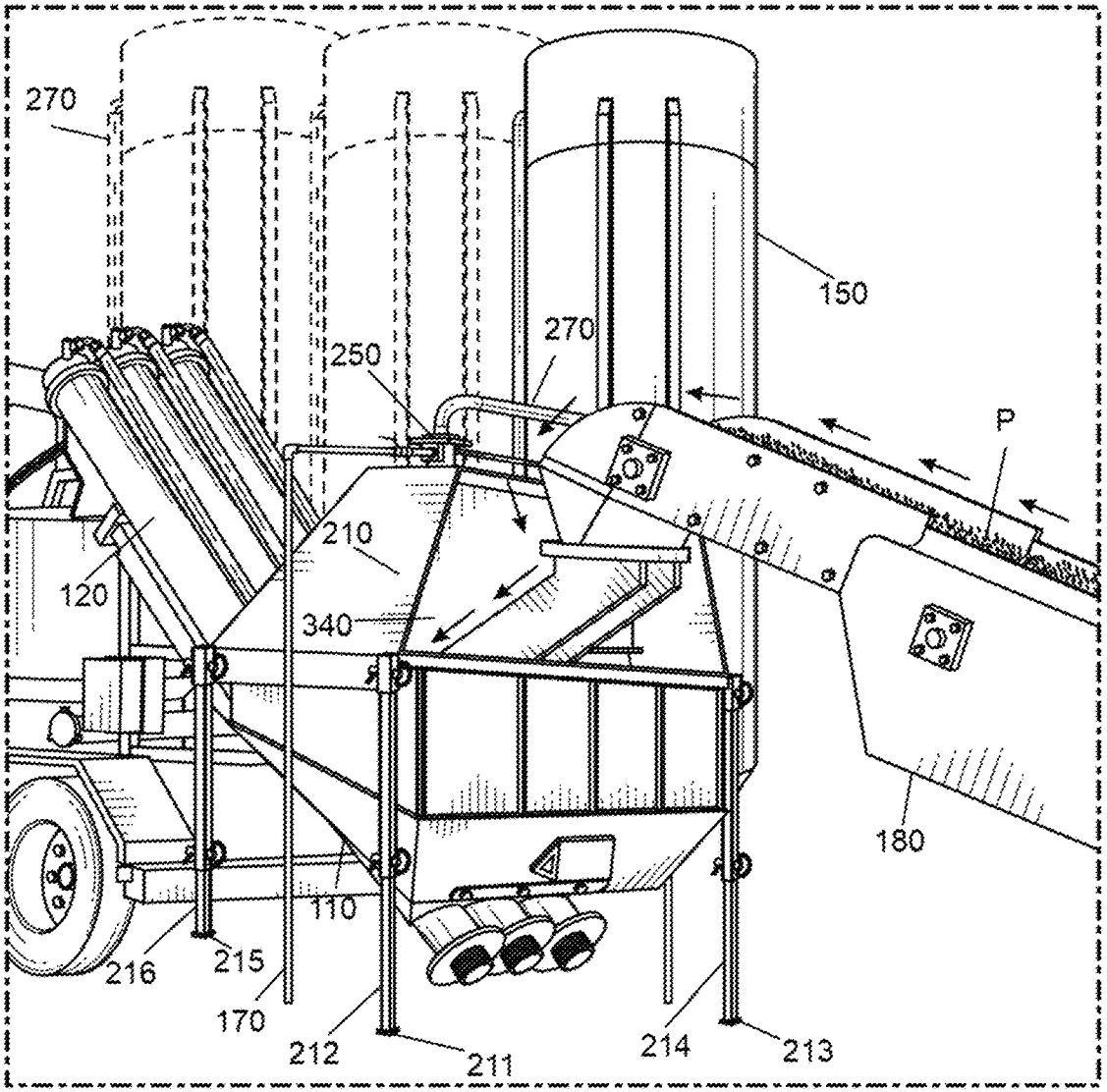
FIG. 2 is a perspective view of a re-circulatory silica dust system positioned at a hydrocarbon oil and gas fracturing well according to an embodiment of the present disclosure.

An embodiment of a silica dust mitigation and recirculation system 200 for a hydrocarbon well site as described herein may be used for recirculating silica dust generated during sand proppant handling to mitigate the release of the silica dust into the surrounding as illustrated in FIGS. 1 and 2.

Figure 5:
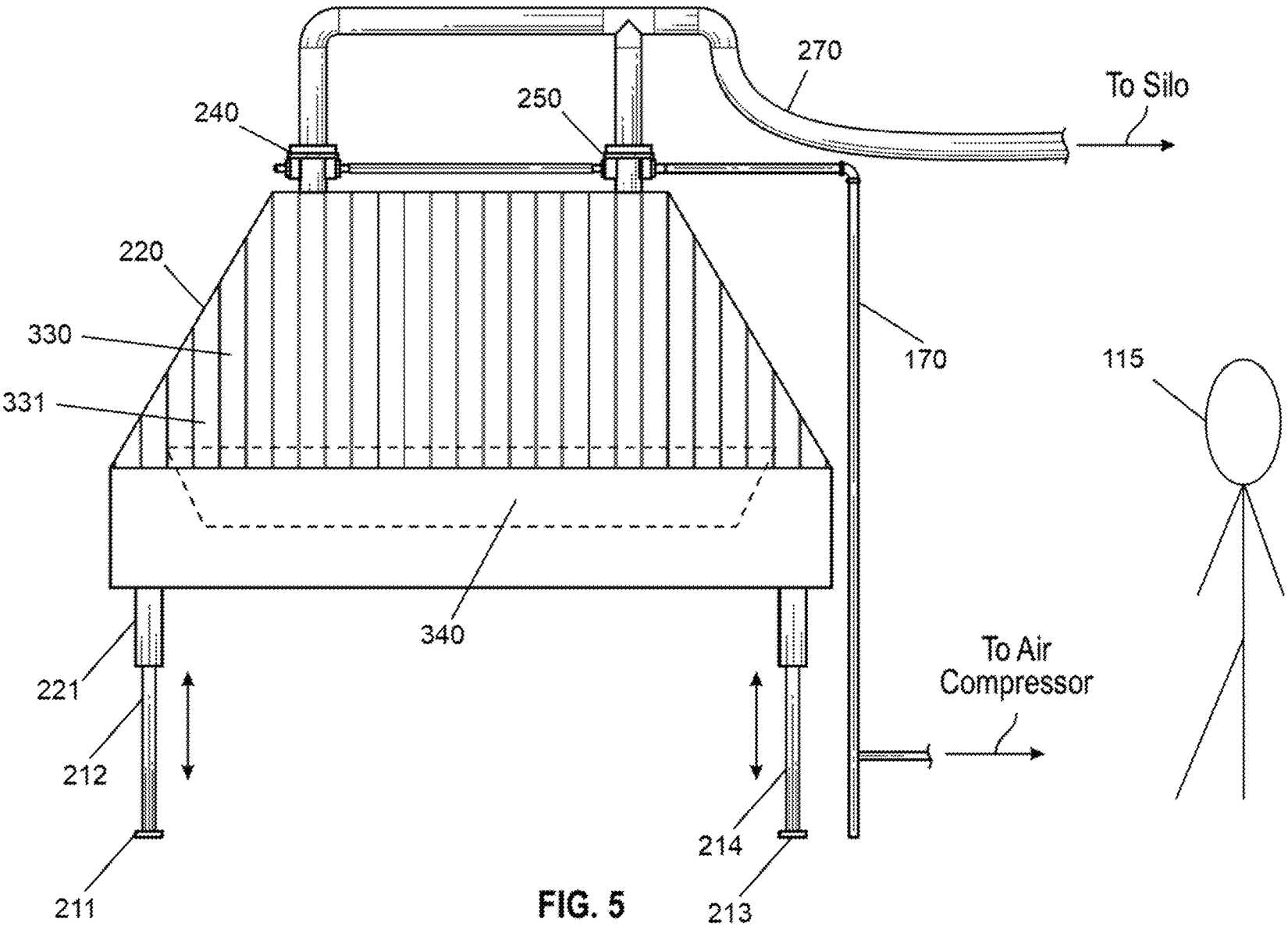
FIG. 5 is a front elevational view of a footed hood according to an embodiment of the present disclosure.
Figure 6:
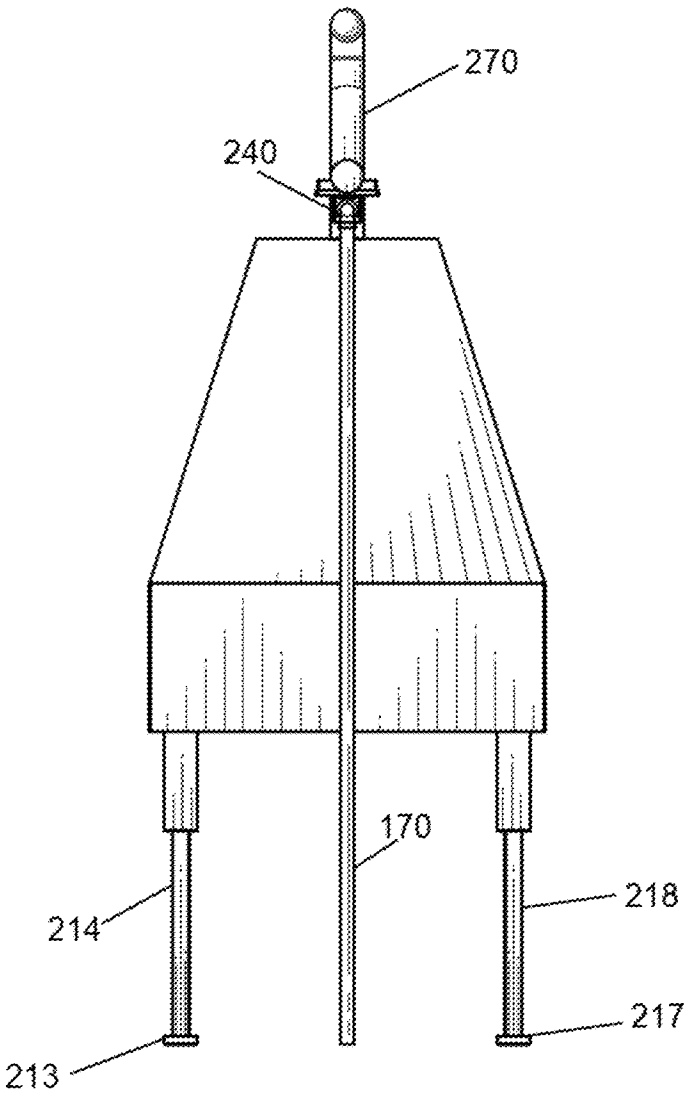
FIG. 6 is a left side elevational view of a footed hood according to an embodiment of the present disclosure.

Referring to FIG. 5, the embodiment of the system 200 may include a shielded curtain 330 which may allow a system operator 115 to view the interior of a footed hood 210 through the shielded curtain 330 without opening the curtain 330. The system 200 may further allow an opening 340 of the main hood body to be covered by the shielded curtain 330 to retain air and the silica dust within the footed hood 210 during operation as shown in FIG. 5.

In one or more embodiments, a silica dust mitigation and recirculation system 200 for a hydrocarbon well site may include a blender hopper 110 positioned at the hydrocarbon well site and positioned to receive sand proppant P, one or more proppant silos 150 positioned at a selected distance from the blender hopper 110 at the hydrocarbon well site and having an interior chamber to store sand proppant P therein as illustrated in FIG. 1.

The embodiment of a silica dust mitigation and recirculation system 200 may also include a footed hood 210 configured to be positioned to overlie the blender hopper 110 as illustrated in FIGS. 1 and 2. Now referring to FIG. 4, an embodiment of the footed hood 210 may include a main hood portion 220 having one or more outlets 222, 224 to provide a fluid outlet path from the footed hood 210 to the one or more proppant silos 150 (not shown).

In one embodiment, a silica dust mitigation and recirculation system 200 may further include a conveyor 180 having a proximal end portion and a distal end portion as illustrated in FIG. 1. FIG. 1 shows the proximal end portion being positioned adjacent a lower portion of the one or more proppant silos 150 and the distal end portion being positioned adjacent a lower portion of the footed hood 210 and positioned to feed sand proppant P to the blender hopper 110.

Figure 4:
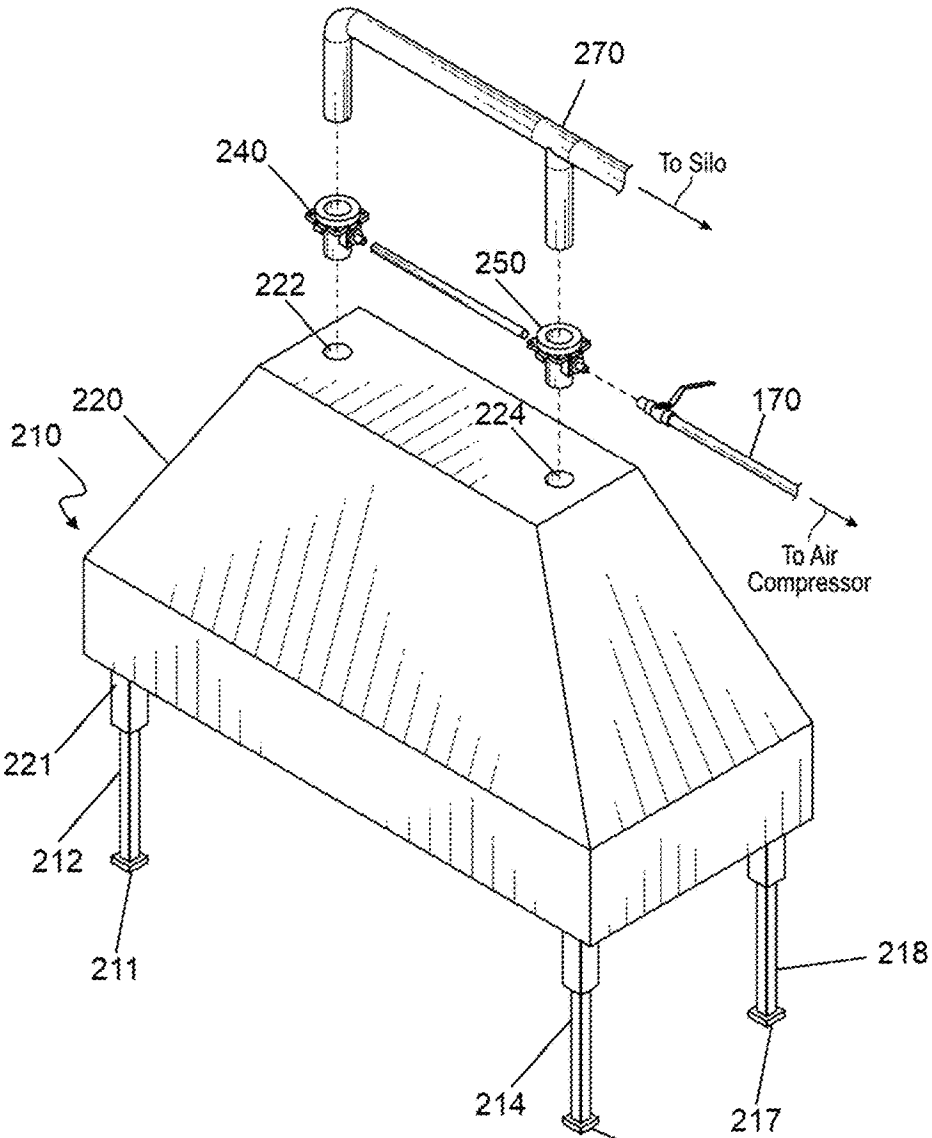
FIG. 4 is an exploded perspective view of a footed hood, air amplifiers, vacuum hoses, and air hoses according to an embodiment of the present disclosure.
Figure 10:
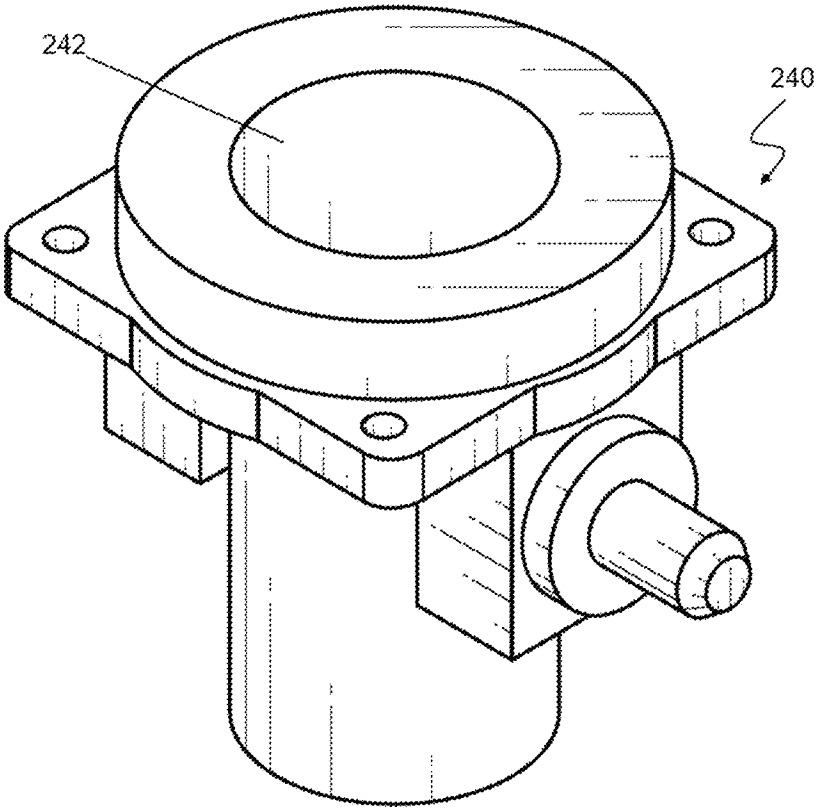
FIG. 10 is an enlarged perspective view of the air amplifier according to an embodiment of the present disclosure.
Figure 11:
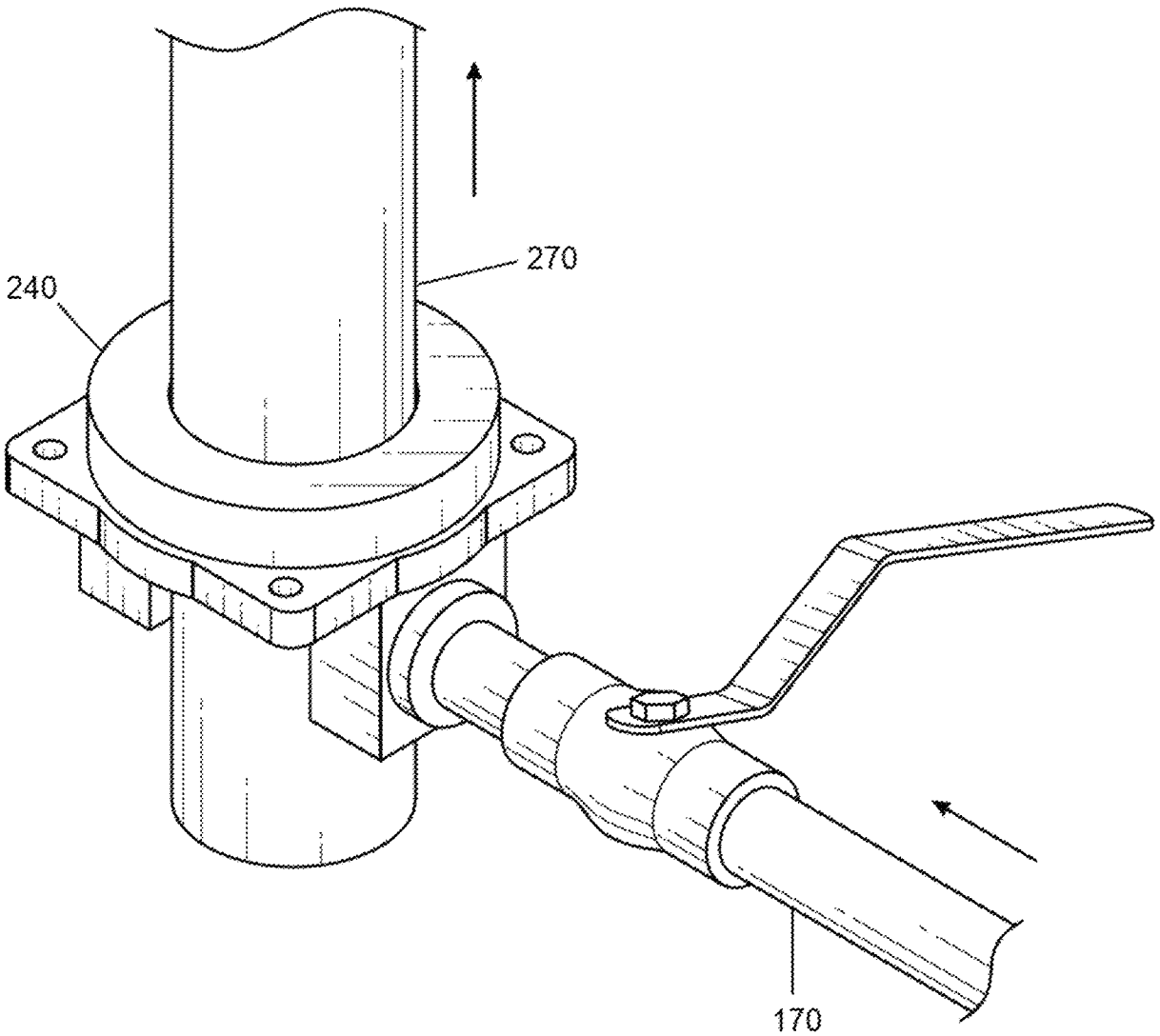
FIG. 11 is a perspective view of the air amplifier with air hose and vacuum hose connected thereto with arrows illustrating air flow according to an embodiment of the present disclosure.

As illustrated in FIG. 4, the embodiment of a silica dust mitigation and recirculation system 200 may also include, for example, one or more air amplifiers 240, 250 connected to the main hood portion 220 of the footed hood 210 to amplify air adjacent the one or more outlets 222, 224 of the main hood portion 220 of the footed hood 210 and thereby enhance drawing of air and generated silica dust in regions underlying the footed hood 210 and overlying the blender hopper 110 (not shown) by vacuum pressure through the one or more outlets 222, 224 of the main hood portion 220 of the footed hood 210. FIG. 10 shows an enlarged perspective view of the one or more air amplifiers 240 and FIG. 11 illustrates a perspective view of the one or more air amplifiers 240 with an air hose 170 and one or more vacuum hoses 270 connected thereto with arrows illustrating air flow.

Figure 3:
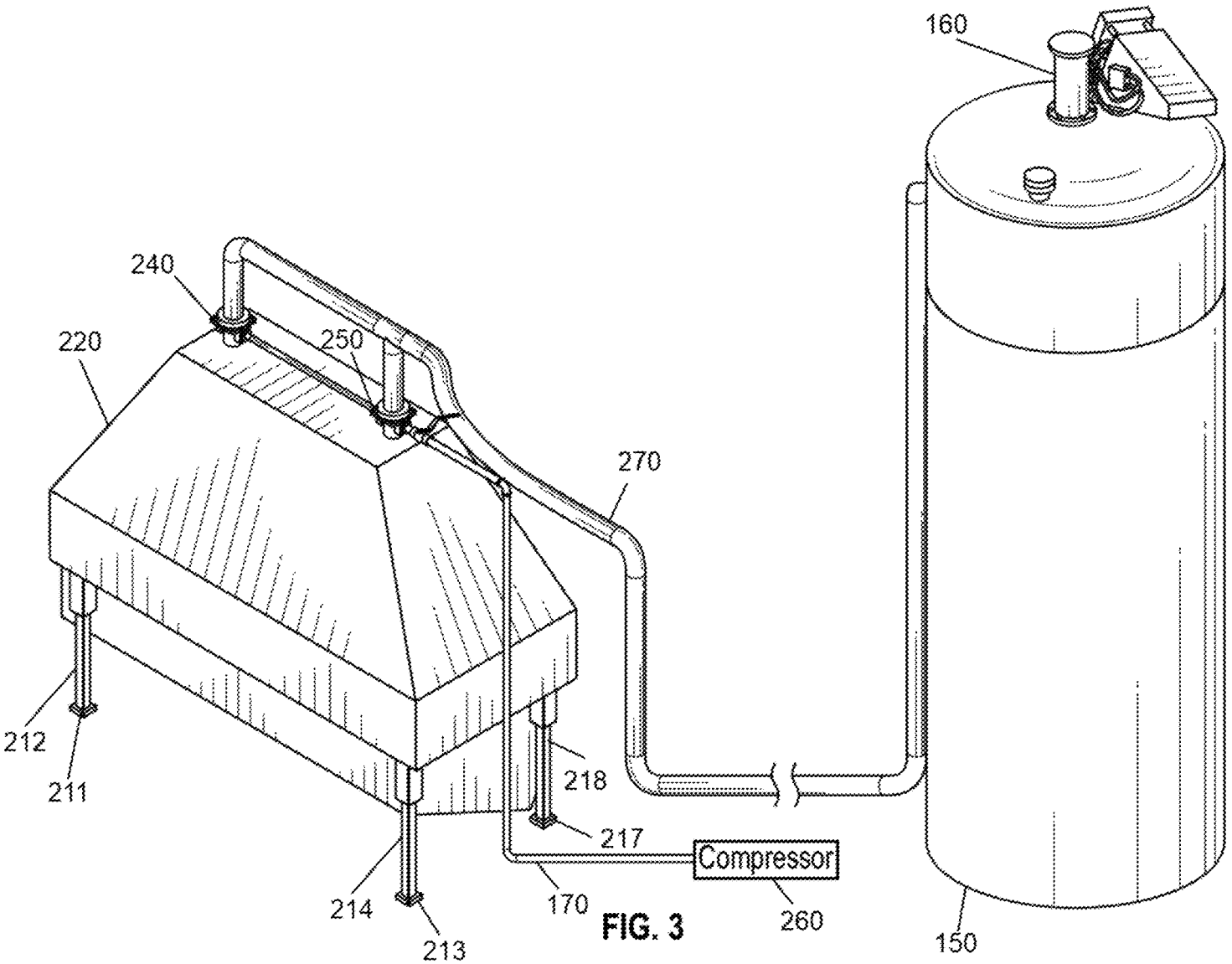
FIG. 3 is an enlarged perspective view of a footed hood with the vacuum hoses recirculating back to the proppant according to an embodiment of the present disclosure.

According to an embodiment of the present disclosure, a silica dust mitigation and recirculation system 200 may further include one or more compressed air sources 260 positioned to provide compressed air to the one or more air amplifiers 240, 250 as shown in FIG. 3.

In one embodiment, a silica dust mitigation and recirculation system 200 may also include one or more vacuum hoses 270 in fluid communication with the one or more outlets 222, 224 of the main hood portion 220 of the footed hood 210 and extending away therefrom to the one or more sand proppant silos 150 to provide a path for the generated silica dust from the footed hood 210 to the one or more sand proppant silos 150. As shown in FIG. 1, the generated silica dust being removed from regions overlying the blender hopper 110 and fluidly recirculated to the one or more sand proppant silos 150 for storage therein and to be supplied once again for conveyance on the conveyor 180.

As illustrated in FIGS. 1 and 2, an embodiment of a conveyor 180 conveys sand proppant P thereon from the one or more proppant silos 150 to the blender hopper 110 through an opening 340 adjacent the lower portion of the footed hood 210 and feeds sand proppant P to an augur 120 having an end thereof positioned to underlie the blender hopper 110 so that the augur 120 transfers sand proppant P being fed thereto further to a blender positioned on a back of a truck 190 thereby to blend sand proppant P prior to injection of blended sand proppant under pressure down into a well located at the hydrocarbon well site.

Shown in FIG. 5 is a front elevational view of an embodiment of a main hood portion 220 of a footed main hood. The main hood body may have a shielded curtain portion 330 positioned adjacent the distal end portion of the conveyor 180 from which sand proppant P is being conveyed into the blender hopper 110. In one embodiment, the shielded curtain portion 330 may be transparent or translucent to allow viewing therethrough during operation in a region under the main hood portion and into the blender hopper 110.

Figure 8:
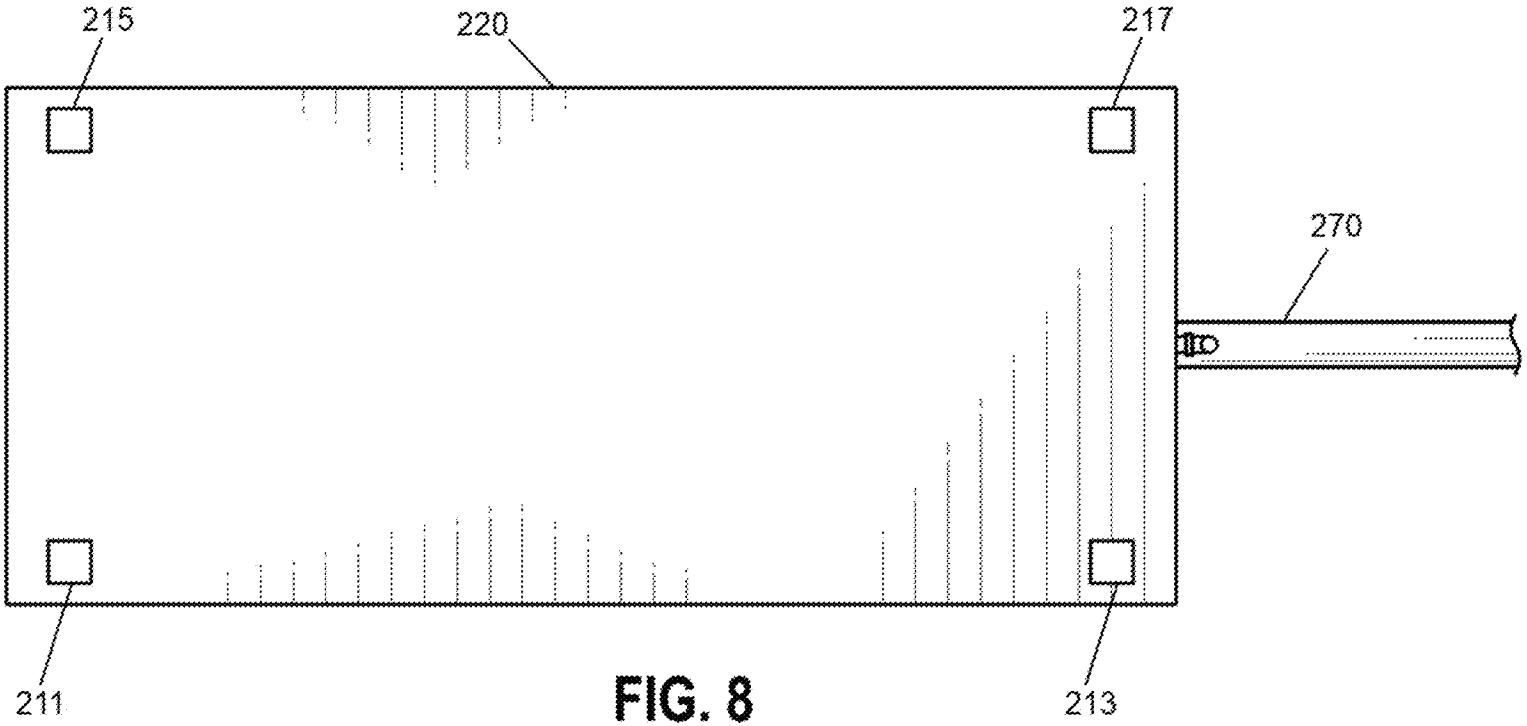
FIG. 8 is a bottom plan view of a footed hood according to an embodiment of the present disclosure.

According to an embodiment of the present disclosure and illustrated in FIGS. 3 and 4, the footed hood 210 may further include a plurality of support legs 212, 214, 216 (not shown), 218 connected to and extending downwardly from lower peripheries of the main hood portion and a plurality of feet 211, 213, 215 (not shown), 217 each connected to a respective one of the plurality of support legs 212, 214, 216 (not shown), 218 to enhance support for the footed hood 210 on a support surface at the hydrocarbon well site. FIG. 8 shows a bottom plan view of the footed hood and a plurality of feet 211, 213, 215, 217.

Figure 13:
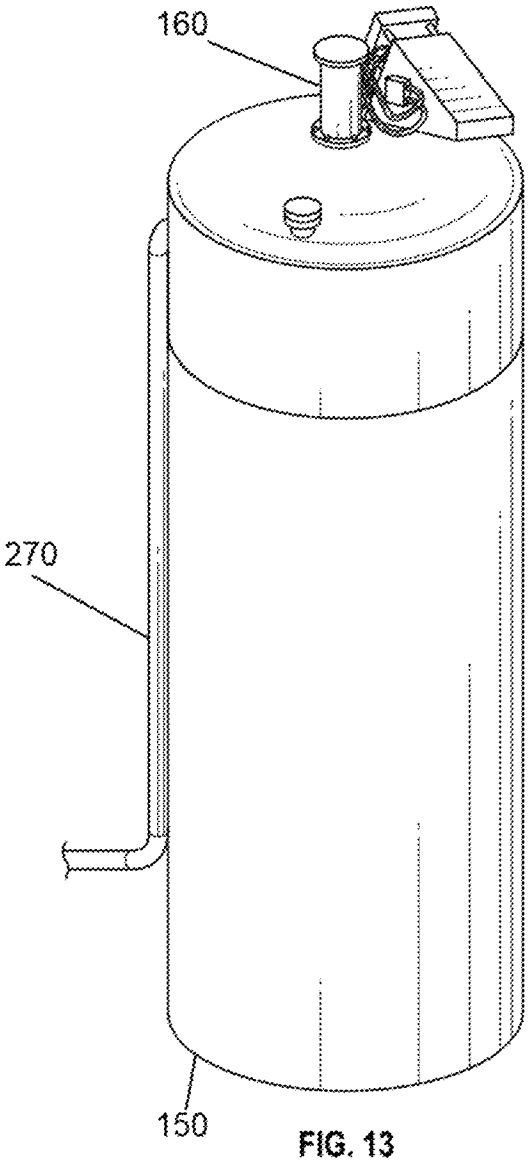
FIG. 13 is a perspective view of the upper portion of proppant silo showing the vacuum hose feeding to dust filter collection system located in upper portions of silo according to an embodiment of the present disclosure.

As will be recognized by those skilled in the art, FIG. 3 illustrates the one or more vacuum hoses 270 extending to the one or more proppant silos 150 and connecting in a region closely adjacent the one or more proppant silos 150 thereafter to extend upwardly along a vertical extent of each of the one or more proppant silos 150 to the sand silo filter arrangement 160 positioned in the upper region of each of the one or more proppant silos 150. FIG. 13 illustrates a perspective view of the upper portion of the one or more proppant silos 150 showing the vacuum hose feeding to the sand silo filter arrangement 160 located in the upper region of the one or more proppant silos 150 according to an embodiment of the present disclosure.

According to another embodiment of the present disclosure, each of the plurality of support legs 212, 214, 216, 218 of the footed hood 210 further includes two or more leg segments and a leg adjustment arrangement 221 positioned to adjust the extent of at least one of the two or more support leg segments to thereby adjust the overall vertical extent of each of the plurality of support legs 212, 214, 216, 218 and thereby, in turn, to adjust overall height of the footed hood 210 to a selected height so that the main hood portion overlies the blender hopper 110 at a desired elevational location. FIG. 5 shows the two or more leg segments and the leg adjustment arrangement 221 positioned to adjust the extent of at least one of the two or more support leg segments to thereby adjust the overall vertical extent of each of the plurality of support legs 212, 214, 216 (not shown), 218.

Figure 7:
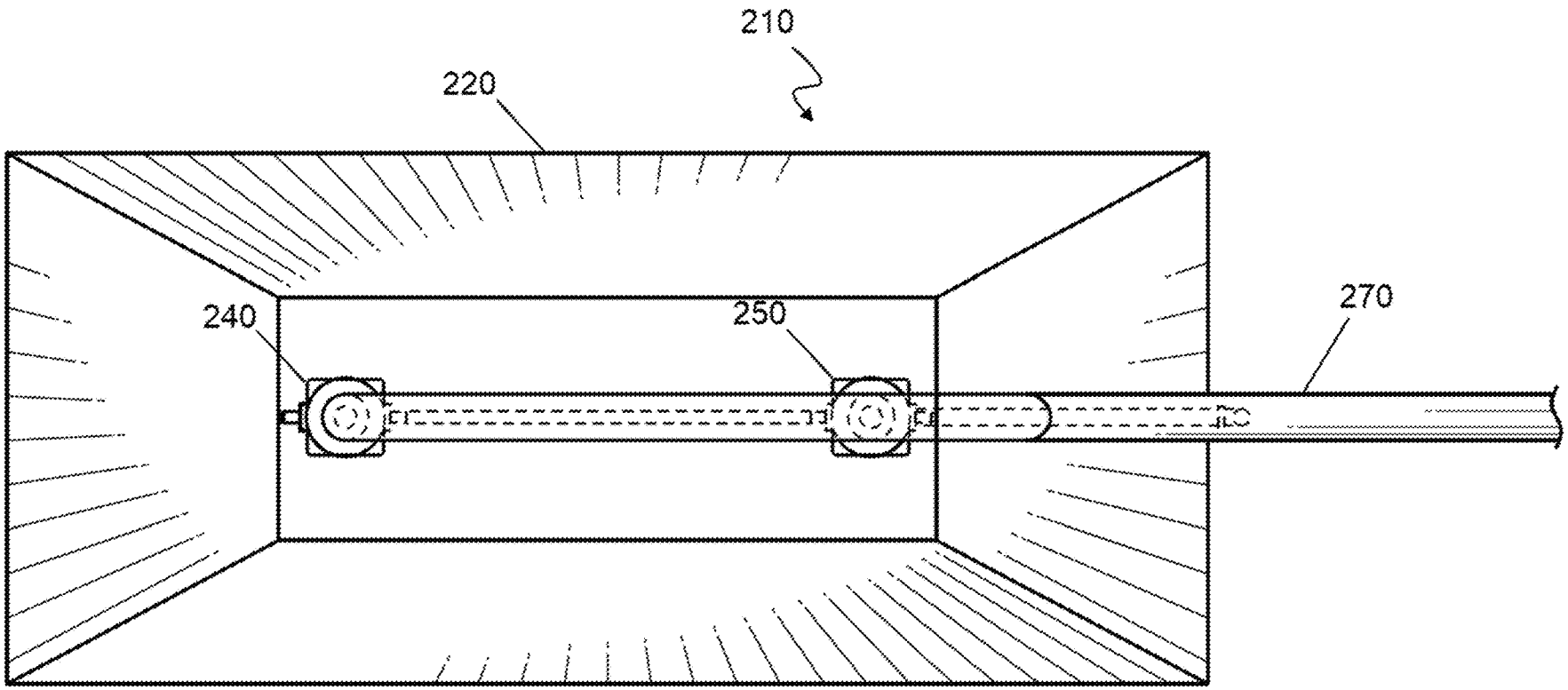
FIG. 7 is a top plan view of a footed hood according to an embodiment of the present disclosure.

In one or more embodiments, a silica dust mitigation and recirculation system 200 for a hydrocarbon well site may include a footed hood 210 configured to be positioned to overlie a blender hopper 110 when positioned on a hydrocarbon well site. FIG. 7 illustrates a top plan view of the footed hood 210. In one embodiment, the blender hopper 110 may be positioned to receive sand proppant P from a conveyor 180 when positioned so that conveyor 180 feeds sand proppant P thereto, passes sand proppant P through the blender hopper 110, and feeds sand proppant P to an augur 120 so that the augur 120 transfers sand proppant P being fed thereto to a blender thereby to blend sand proppant P prior to injection of blended sand proppant under pressure down into a hydrocarbon well located at the hydrocarbon well site.

In another embodiment, the footed hood 210 may have a main hood portion 220, a plurality of support legs 212, 214, 216, 218 connected to and extending downwardly from lower peripheries of the main hood portion 220, and a plurality of feet 211, 213, 215, 217 each connected to a respective one of the plurality of support legs 212, 214, 216, 218 to enhance support for the footed hood 210 on a support surface at the well site. FIG. 4 shows the embodiment of the plurality of support legs 212, 214, 216 (not shown), 218 connected to and extending downwardly from lower peripheries of the main hood portion 220. The embodiment of the main hood portion 220 may be positioned to overlie upper peripheries of the blender hopper 110.

Embodiments of the plurality of support legs 212, 214, 216, 218 may extend downwardly so that each of the plurality of feet 211, 213, 215, 217 may contact the underlying support surface thereby to enhance support of the footed hood 210 on the underlying support surface. FIG. 8 illustrates a bottom view of the footed hood 210 showing the plurality of feet 211, 213, 215, 217.

As illustrated in FIG. 4, an embodiment of the footed hood 210 may further include one or more outlets 222, 224 positioned in an upper region of the main hood portion 220 to provide a fluid outlet path from the footed hood 210.

According to an embodiment of the present disclosure, a silica dust mitigation and recirculation system 200 for a hydrocarbon well site may further include, for example, one or more air amplifiers 240, 250 in fluid communication with the one or more outlets 222, 224 of the footed hood 210 and connected to the footed hood 210 to amplify air being supplied adjacent the one or more outlets 222, 224 being supplied from one or more compressed air sources 260 and thereby enhance drawing of air and associated silica dust by vacuum pressure from the one or more outlets 222, 224 and from the footed hood 210. In one embodiment, the silica dust may be generated in a location underlying the footed hood 210 and overlying the blender hopper 110 when sand proppant P from the conveyor 180 is being conveyed into the blender hopper 110.

A silica dust mitigation and recirculation system 200 for a hydrocarbon well site may further include one or more vacuum hoses 270 connected to an outlet 242 of the one or more air amplifiers 240, 250 and in fluid communication therewith to provide a fluid flow path under vacuum pressure from the one or more air amplifiers 240, 250 and extending away therefrom to one or more sand proppant silos 150 each of which stores sand proppant P therein when positioned at the hydrocarbon well site.

Figure 14:
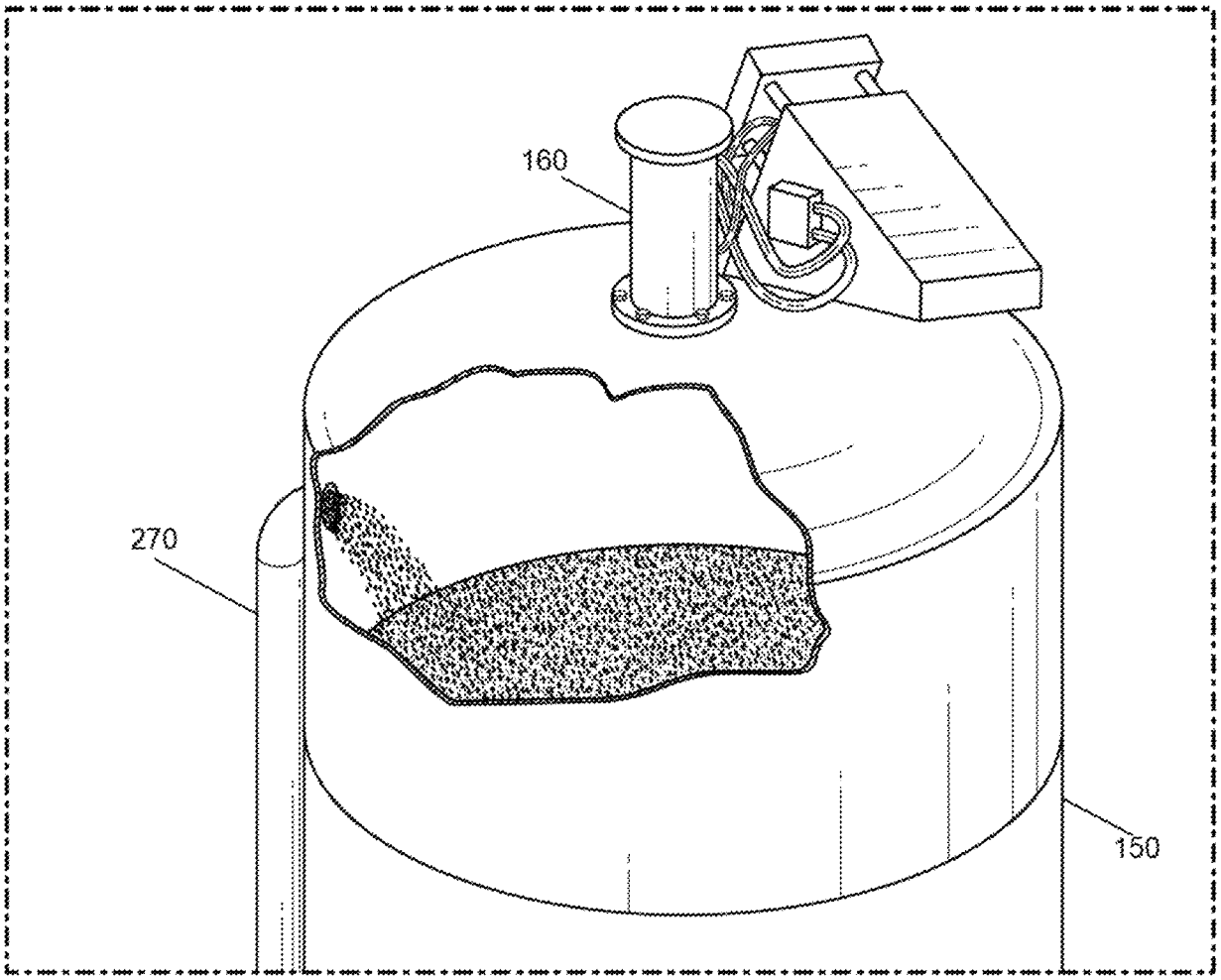
FIG. 14 is an enlarged perspective view of the upper portion of proppant silos with portions broken away to show the vacuum hose feed into the interior upper portion of the silo for filtration therein and feed back into the stored proppant in the silo according to an embodiment of the present disclosure.

As illustrated in FIG. 14, an embodiment of a silica dust mitigation and recirculation system 200 may further include the one or more vacuum hoses 270 further extending and connecting to a sand silo filter arrangement 160 positioned in an upper portion of each of the one or more sand proppant silos 150 to enhance filtering of sand proppant P and so that silica dust being fluidly supplied under vacuum pressure from the one or more outlets 222, 224 of the footed hood 210 and through the one or more vacuum hoses 270 recirculates to the one or more sand proppant silos 150 for storage therein to be supplied once again for conveyance on the conveyor 180 thereby to provide a silica dust removal and re-circulation path for the silica dust when generated in regions overlying the blender hopper 110. FIG. 14 illustrates the upper portion of the one or more proppant silos 150 with portions broken away to show the one or more vacuum hoses feed 270 into the interior upper portion of the one or more proppant silos 150 for filtration therein and feed back into the stored proppant in the one or more proppant silos 150 according to an embodiment of the present disclosure.

FIG. 5 illustrates each of the plurality of support legs 212, 214, 216 (not shown), 218 (not shown) of the footed hood 210 may include two or more leg segments and a leg adjustment arrangement 221 positioned to adjust the extent of at least one of the two or more leg segments to thereby adjust the overall vertical extent of each of the plurality of support legs 212, 214, 216 (not shown), 218 (not shown) and thereby, in turn, to adjust overall height of the footed hood 210 to a selected height so that the main hood portion 220 overlies the blender hopper 110 at a desired elevational location.

FIG. 3 illustrates an embodiment of the one or more vacuum hoses 270 that may extend to the one or more sand proppant silos 150 and may connect in a region closely adjacent the one or more sand proppant silos 150 thereafter to extend upwardly along a vertical extent of the one or more proppant silos 150 to the filter arrangement 160 positioned in an upper region of the one or more sand proppant silos 150.

According to an embodiment of the present disclosure, the main hood portion 220 may include a main hood body having a shielded curtain portion 330 positioned adjacent an end of the conveyor 180 from which sand proppant is being fed into the blender hopper 110. Embodiments of the shielded curtain portion 330 may be formed of a material to allow viewing therethrough during operation in a region under the main hood portion 220 and into the blender hopper 110 when a system operator 115 is positioned adjacent thereto.

Figure 12:
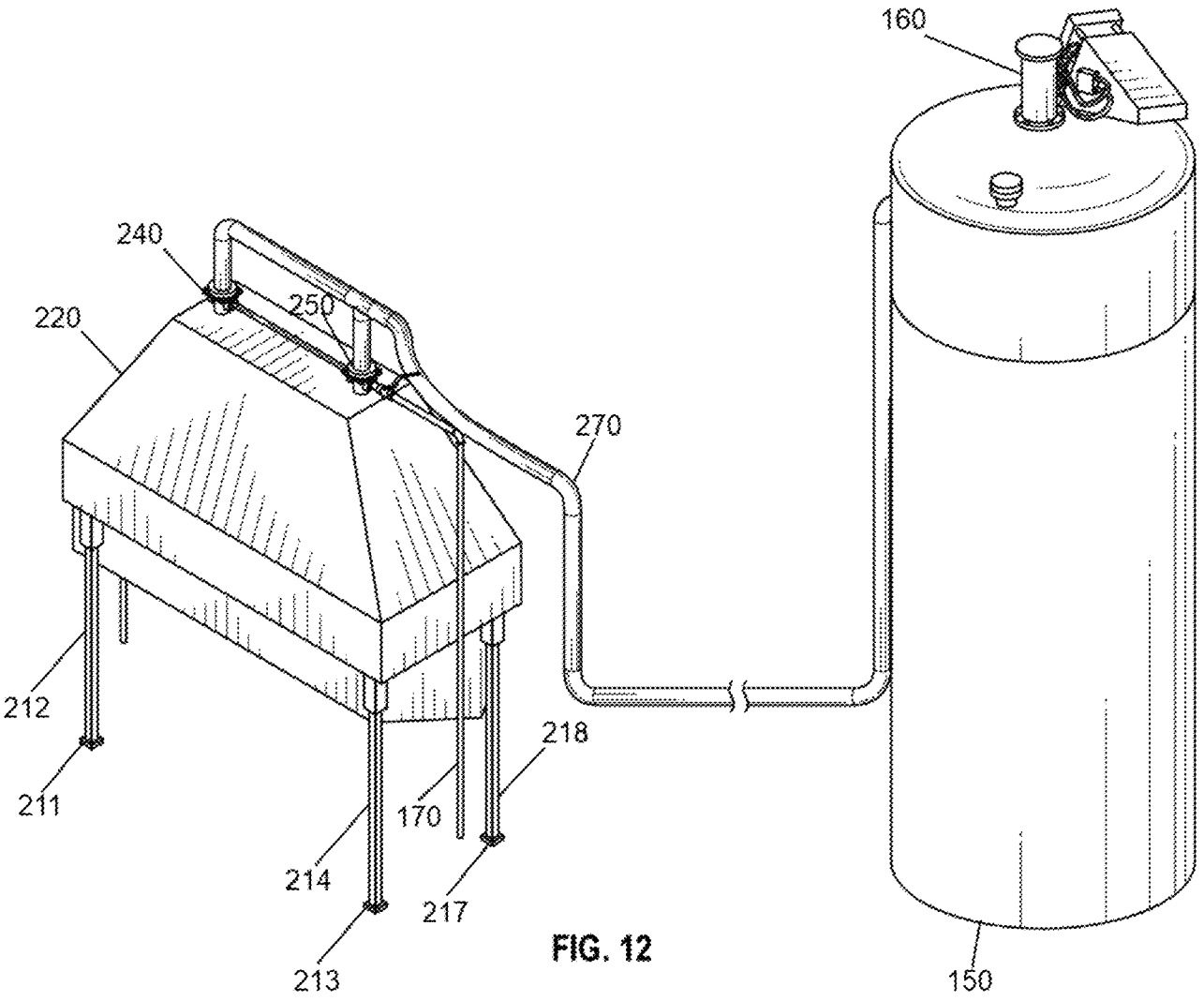
FIG. 12 is a perspective view of legs of the footed hood showing adjustable to heights of different blender hopper heights according to an embodiment of the present disclosure.

As illustrated in FIGS. 12-14, a silica dust mitigation and recirculation system 200 for a hydrocarbon well site may further include one or more air hoses 170 connected to and in fluid communication with the one or more air amplifiers 240, 250 and an air compressor 260 (not shown) positioned to supply compressed air to the one or more air hoses 170, and wherein each of the one or more air amplifiers 240, 250 comprises a transvector jet arrangement.

In or more embodiments, a footed hood 210 configured to be positioned to overlie a blender hopper 110 for mitigating silica dust at a hydrocarbon well site may include a main hood portion 220 having one or more outlets 222, 224 to provide a fluid outlet path from the footed hood 210 to one or more proppant silos 150 positioned at a selected distance from the blender hopper 110.

In one embodiment, the footed hood 210 may further include a main hood body having an opening 340 adjacent an end of a conveyor 180 from which sand proppant P is being fed into the blender hopper 110.

In another embodiment of the present disclosure, the footed hood 210 may further include a shielded curtain portion 330 being formed of a transparent or translucent material to allow viewing therethrough and without opening the shielded curtain portion 330 during operation. Embodiments of the shielded curtain portion 330 may be positioned as a cover for the opening 340 of the main hood body to thereby retain air and the silica dust within the footed hood 210.

Figure 9:
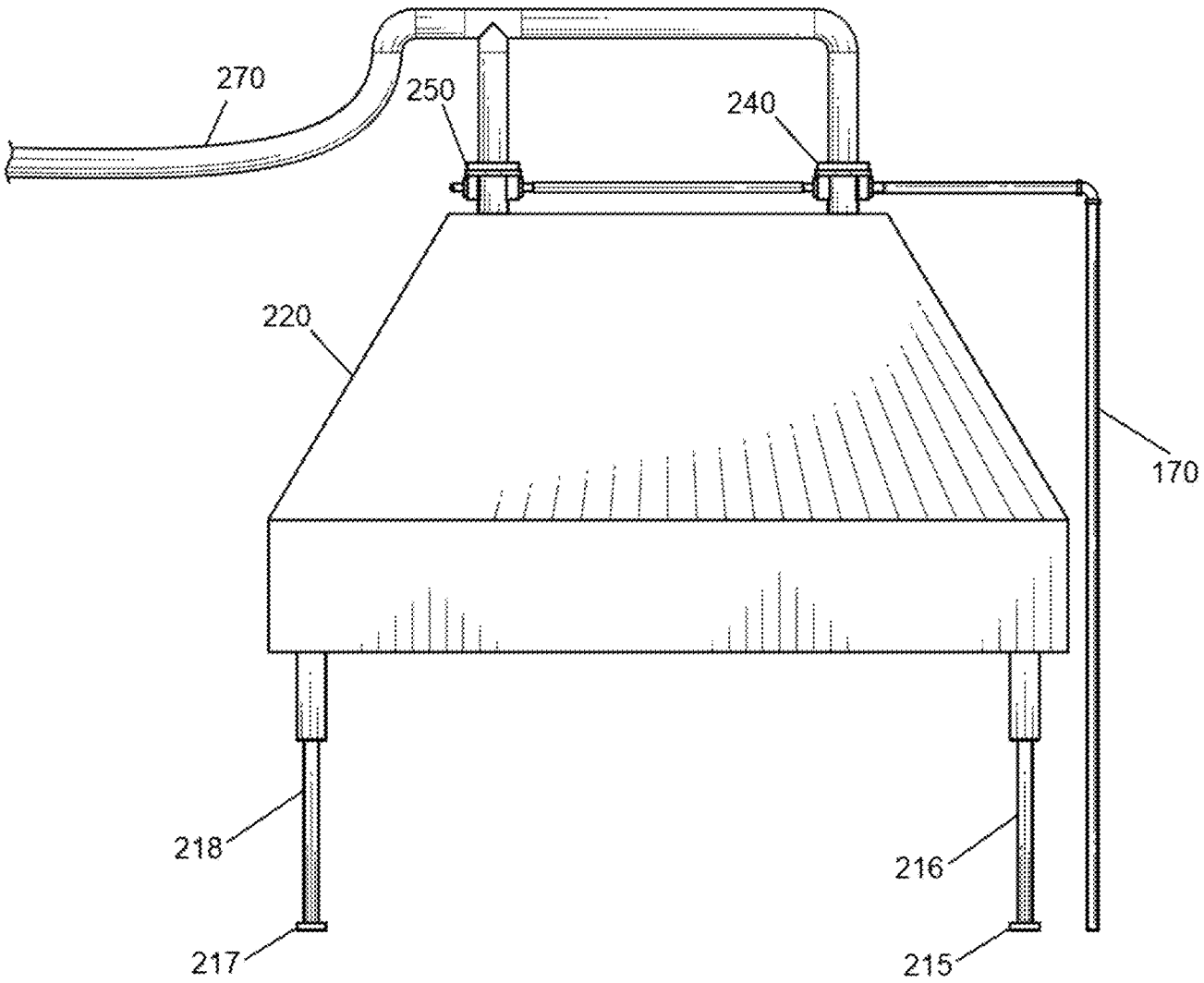
FIG. 9 is a rear plan view of a footed hood according to an embodiment of the present disclosure.

According to an embodiment of the present disclosure, the footed hood 210 may further include a plurality of support legs 212, 214, 216, 218 connected to and extending downwardly from lower peripheries of the main hood portion 220 and a plurality of feet 211, 213, 215, 217, 213, 215, 217 each connected to a respective one of the plurality of support legs 212, 214, 216, 218 to enhance support for the footed hood 210 on a support surface at the hydrocarbon well site. FIG. 9 is a rear plan view of the footed hood 210 showing the main hood portion 220, the plurality of legs 212, 214, 216, 218 connected to and extending downwardly from lower peripheries of the main hood portion 220 and a plurality of feet 211, 213, 215, 217 according to an embodiment of the present disclosure.

In one embodiment, the shielded curtain portion 330 may include a plurality of vertically hanging strips 331 as shown in FIG. 5. The plurality of vertically hanging strips 331, for example, may be flexible. Embodiments of the plurality of vertically hanging strips 331 may be formed of a transparent or translucent material to allow viewing therethrough. Each of the plurality of the vertically hanging strips 331 may have a pair of horizontal short edges separated by a selected vertical dimension and the selected vertical dimension may define a length of each of the plurality of vertically hanging strips 331 to span the opening of the main hood body of the footed hood 210.

In another embodiment, each of the plurality of vertically hanging strips 331 may have a pair of vertical long edges separated by a selected horizontal dimension and the selected horizontal dimension may define a width of each of the plurality of vertically hanging strips 331. The length and the width may define an area of each of the plurality of vertically hanging strips.

According to an embodiment of the present disclosure, the pair of horizontal short edges of each of the plurality of vertically hanging strips 331 may include a proximal short edge portion and a distal short edge portion. The proximal short edge portion may be suspended from adjacent an edge of the main hood portion 220 and the distal short edge portion may be terminated adjacent a lower region of the main hood body of the footed hood 210 to substantially cover height of the opening 340. Each of the plurality of vertically hanging strips 331 may overlap one another to partially cover the opening 340 into which the end of the conveyor 180 enters the main hood body of the footed hood 210.

In another embodiment, each of the plurality of support legs 212, 214, 216, 218 of the footed hood 210 may further include two or more leg segments and a leg adjustment arrangement 221 positioned to adjust the extent of at least one of the two or more support leg segments to thereby adjust the overall vertical extent of each of the plurality of support legs 212, 214, 216, 218 and thereby, in turn, to adjust overall height of the footed hood 210 to a selected height so that the main hood portion 220 overlies the blender hopper 110 at a desired elevational location.

In one or more embodiments, a method 400 may be used for mitigating and recirculating silica dust at a hydrocarbon well site. For purposes of illustration, an embodiment of a plurality of a method 400 depicted in FIG. 20 may be implemented using the silica dust mitigation and recirculation system 200 for a hydrocarbon well site.

In one embodiment, the method 400 may begin at step 410 by conveying sand proppant P on a conveyor 180 from one or more proppant silos 150 to a blender hopper 110 positioned at the hydrocarbon well site through a footed hood 210 positioned to overlie the blender hopper 110. The conveyor 180 may have a proximal end portion and a distal end portion. As illustrated in FIG. 1, the proximal end portion may be positioned adjacent lower portion of the one or more proppant silos 150 and the distal end portion may be positioned adjacent a lower portion of the footed hood 210 and may be positioned to feed sand proppant to the blender hopper 110.

In one or more embodiments in the present disclosure, the method 400 may continue with step 430 by directing sand proppant P from the conveyor 180 into the blender hopper 110 through an opening 340 adjacent the lower portion of the footed hood 210 to unload sand proppant P from the conveyor 180 into the blender hopper 110. The unloading of sand proppant P may generate silica dust in regions underlying the footed hood 210 and overlying the blender hopper 110.

According to an embodiment of the present disclosure, the method 400 may further involve step 450, for example, by supplying compressed air to one or more air amplifiers 240, 250 connected to a main hood portion 220 of the footed hood 210 from one or more compressed air sources 260 thereby to create a vacuum in the main hood portion 220 of the footed hood 210. The air and the generated silica dust may be drawn under vacuum pressure from the regions underlying the footed hood 210 and overlying the blender hopper 110 and recirculated from one or more outlets 222, 224 of the footed hood 210 to the one or more proppant silos 150 via one or more vacuum hoses 270.

FIG. 1 illustrates an embodiment of a blender 130 and an augur 120 that may be used in a method 400 used for mitigating and recirculating silica dust at a hydrocarbon well site. After supplying compressed air to one or more air amplifiers 240, 250 at step 450, the method 400 may proceed at step 470 with directing sand proppant P from the blender hopper 110 to a blender 130 via an augur 120 having an end thereof positioned to underlie the blender hopper 110 and thereby to blend sand proppant prior to injection of blended sand proppant under pressure down into a well located at the hydrocarbon well site.

In one embodiment of the present disclosure, the footed hood 210 may further include a plurality of support legs 212, 214, 216, 218 connected to and extending downwardly from lower peripheries of the main hood portion 220, and a plurality of feet 211, 213, 215, 217 each may be connected to a respective one of the plurality of support legs 212, 214, 216, 218 to enhance support for the footed hood 210 on a support surface at the hydrocarbon well site, and each of the plurality of support legs 212, 214, 216, 218 of the footed hood 210 may include two or more leg segments.

Figure 20:
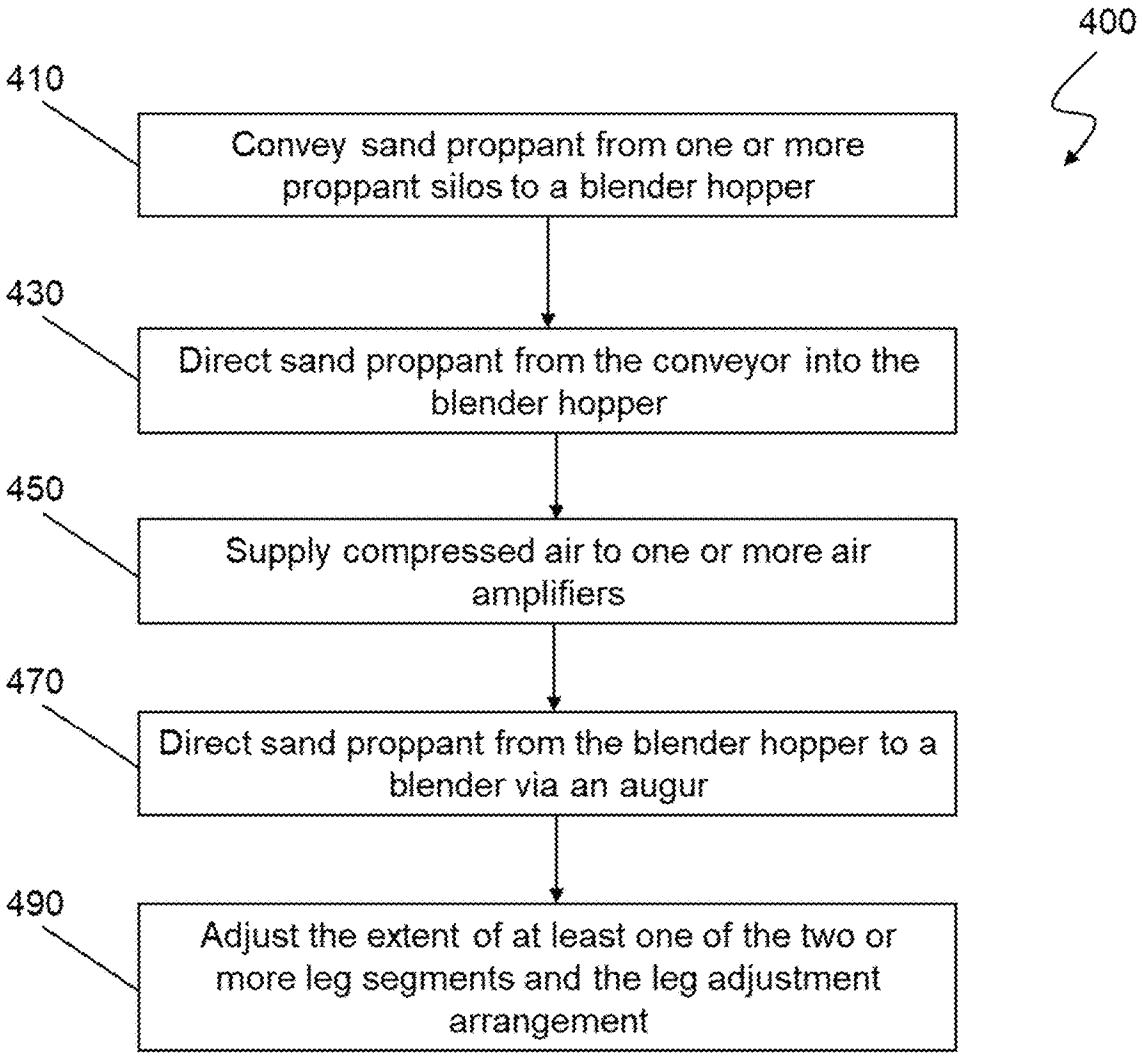
FIG. 20 is a flow diagram illustrating an example of a method for mitigating and recirculating silica dust from a footed hood at a hydrocarbon well site implemented by a re-circulatory silica dust system, according to an embodiment of the present disclosure.

As illustrated in FIG. 20, the method 400 may further involve adjusting 490 the extent of at least one of the two or more leg segments and the leg adjustment arrangement 221 to thereby adjust the overall vertical extent of each of the plurality of support legs 212, 214, 216, 218 and thereby, in turn, to adjust overall height of the footed hood 210 to a selected height so that the main hood portion overlies the blender hopper 110 at a desired elevational location.

In another embodiment, the main hood portion 220 may include a main hood body having a shielded curtain portion 330 positioned adjacent the distal end portion of the conveyor 180 from which sand proppant P is being fed into the blender hopper 110. According to an embodiment to the present disclosure, the shielded curtain portion 330 may be transparent or translucent to allow viewing therethrough during operation in a region under the main hood portion 220 and into the blender hopper 110.

FIG. 12 illustrates the one or more vacuum hoses 270 connected to a sand silo filter arrangement 160 positioned in an upper portion of each of the one or more sand proppant silos 150 to provide enhance filtering of the silica dust before the silica dust to be supplied again for conveyance on the conveyor 180.

As illustrated in FIGS. 10-11, each of the one or more air amplifiers 240 may include a transvector jet arrangement to enhance drawings of the compressed air and the generated silica dust in the footed hood 210 and thereby to remove the silica dust under vacuum pressure from the one or more outlets 222, 224 of the footed hood 210.

Figure 15:
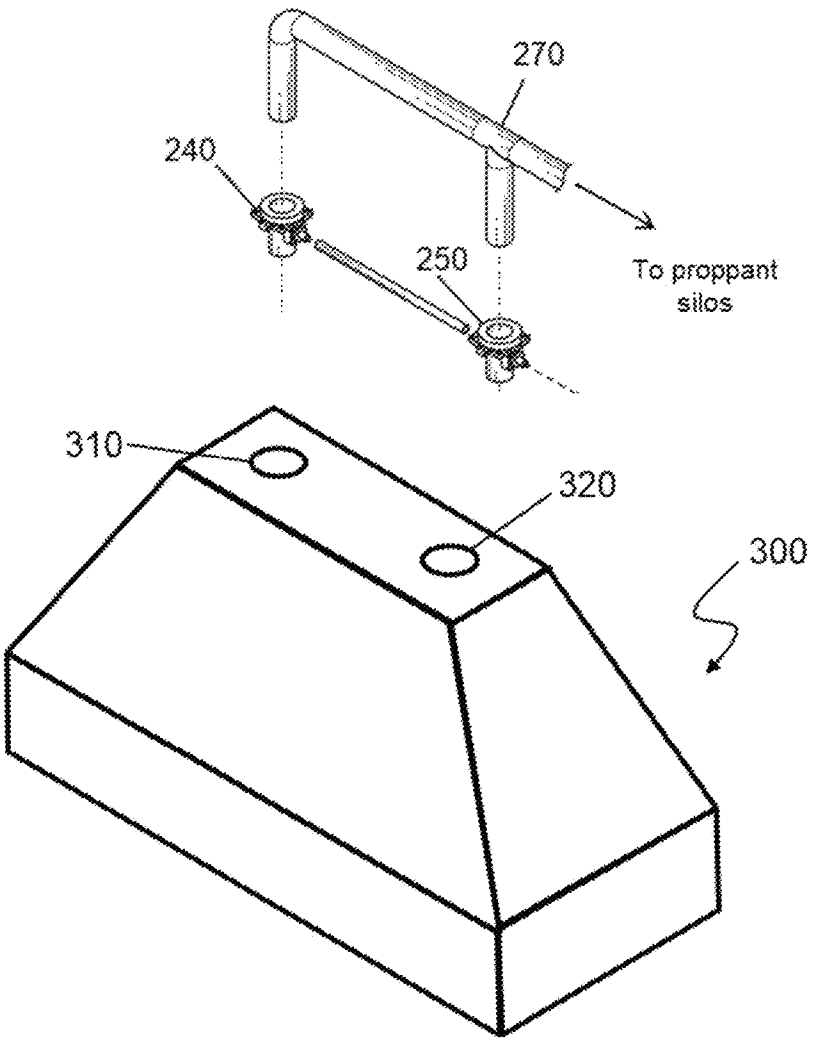
FIG. 15 is a perspective view of a dust hood with the one or more outlets to provide a fluid outlet path from the dust hood to the one or more proppant silos according to an embodiment of the present disclosure.
Figure 17:
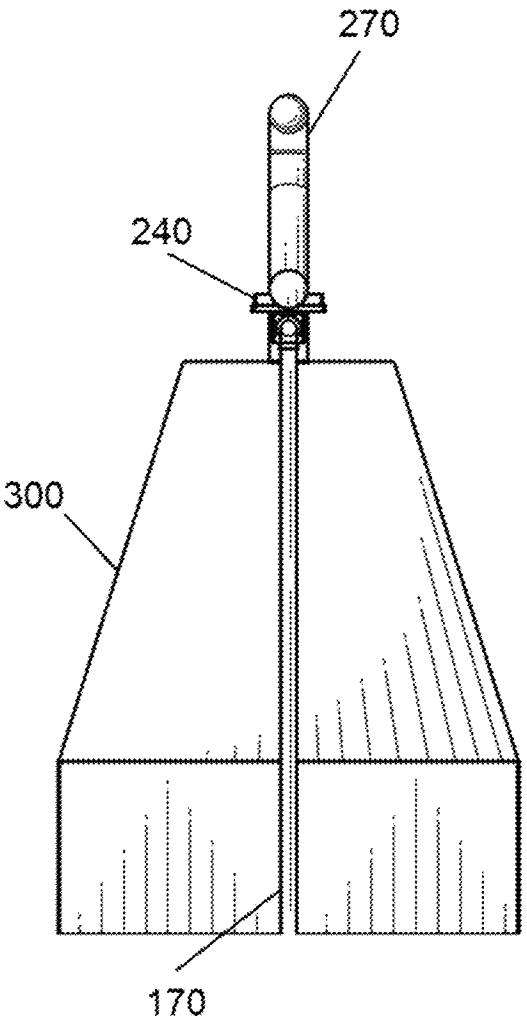
FIG. 17 is a left side elevational view of a dust hood according to an embodiment of the present disclosure.
Figure 19:
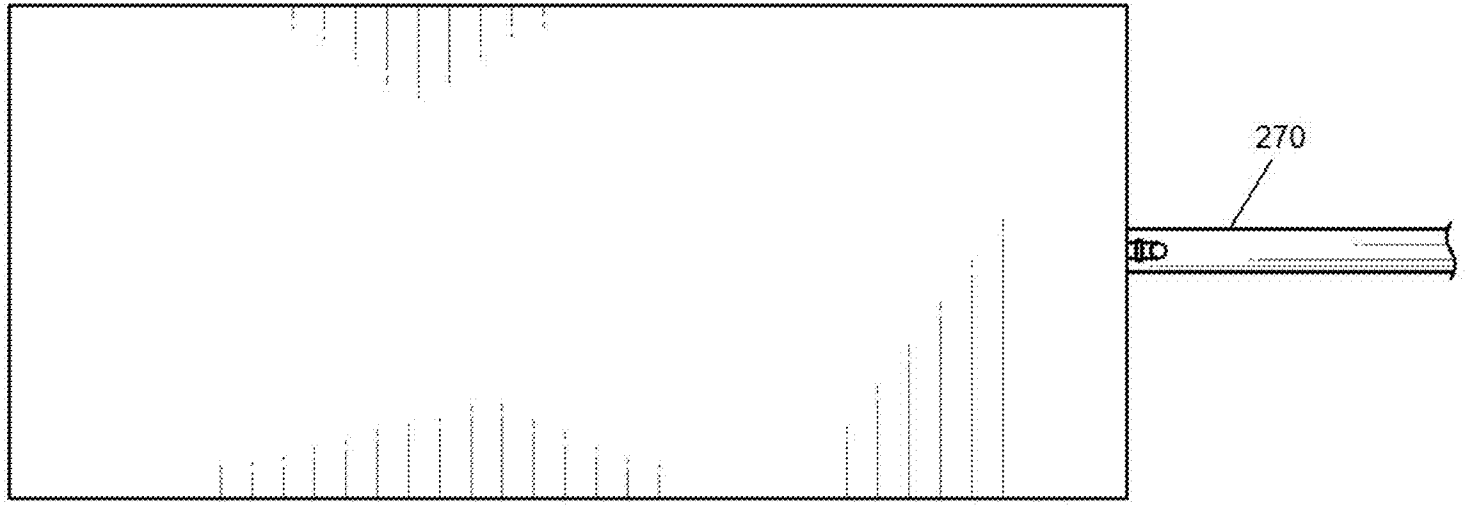
FIG. 19 is a bottom plan view of a dust hood according to an embodiment of the present disclosure.
Figure 21:
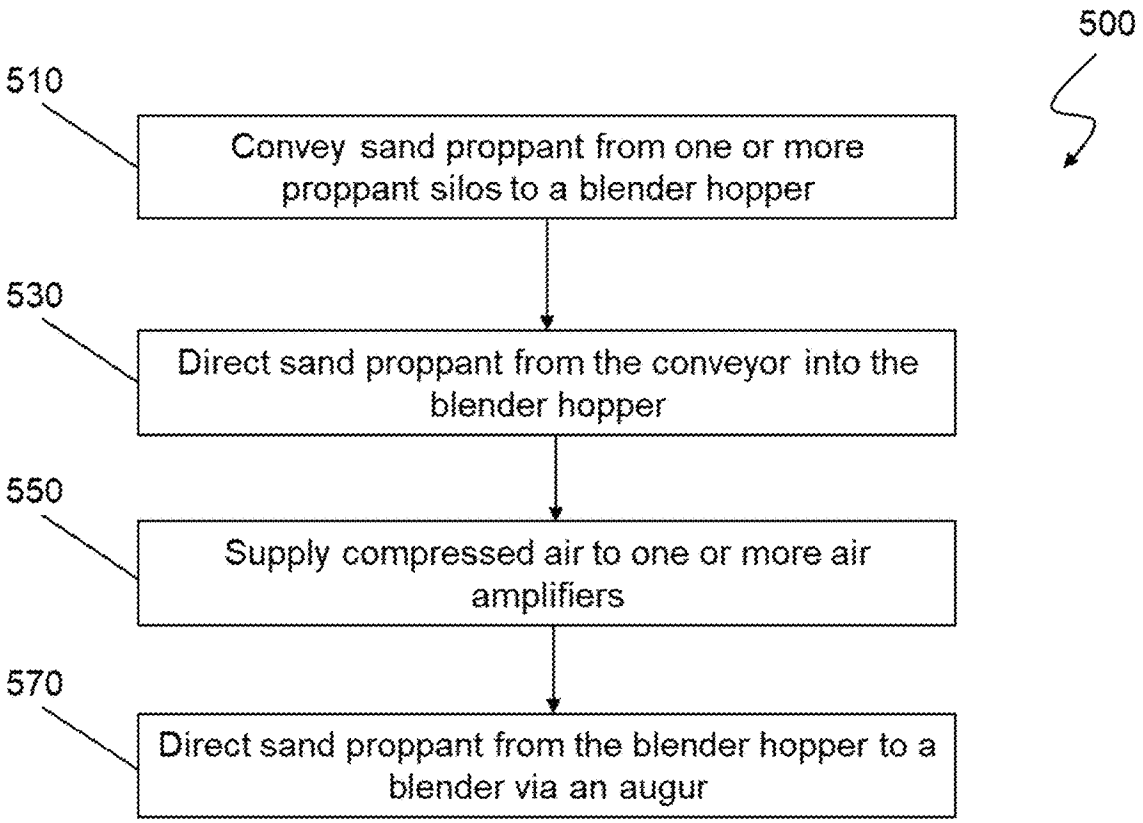
FIG. 21 is a flow diagram illustrating an example of a method for mitigating and recirculating silica dust from a dust hood at a hydrocarbon well site implemented by a re-circulatory silica dust system, according to an embodiment of the present disclosure.

For purposes of illustration, an embodiment of a plurality of a method 500 depicted in FIG. 21 may be implemented using the embodiments of the silica dust removal and recirculation system 200. In one or more embodiments of the present disclosure, a method 500 of mitigating and recirculating silica dust at a hydrocarbon well site may involve conveying 510 sand proppant P on a conveyor 180 from one or more proppant silos 150 to a blender hopper 110 positioned at the hydrocarbon well site through a dust hood 300 positioned to overlie the blender hopper 110. FIG. 15 illustrates a dust hood 300 with the one or more outlets 310, 320 to provide a fluid outlet path from the dust hood 300 to the one or more proppant silos 150 according to an embodiment of the present disclosure. An embodiment of a left side of the dust hood 300 showing an air hose 170 connected to one or more amplifiers 240 is illustrated in FIG. 17. FIG. 19 illustrates a bottom plan view of the dust hood 300 according to an embodiment of the present disclosure.

The conveyor 180 may have a proximal end portion and a distal end portion. The proximal end portion may be positioned adjacent lower portion of the one or more proppant silos 150 and the distal end portion may be positioned adjacent a lower portion of the dust hood 300 and positioned to feed sand proppant to the blender hopper 110.

In yet another disclosed embodiment, the method 500 may also involve directing 530 sand proppant P from the conveyor 180 into the blender hopper 110 through an opening 340 adjacent the lower portion of the dust hood 300 to unload sand proppant P from the conveyor 180 into the blender hopper 110. The dust hood 300 may have one or more outlets 310, 320 to provide a fluid outlet path from the dust hood 300 to the one or more proppant silos 150 and the unloading of sand proppant P may generate silica dust in regions underlying the dust hood 300 and overlying the blender hopper 110.

Figure 18:
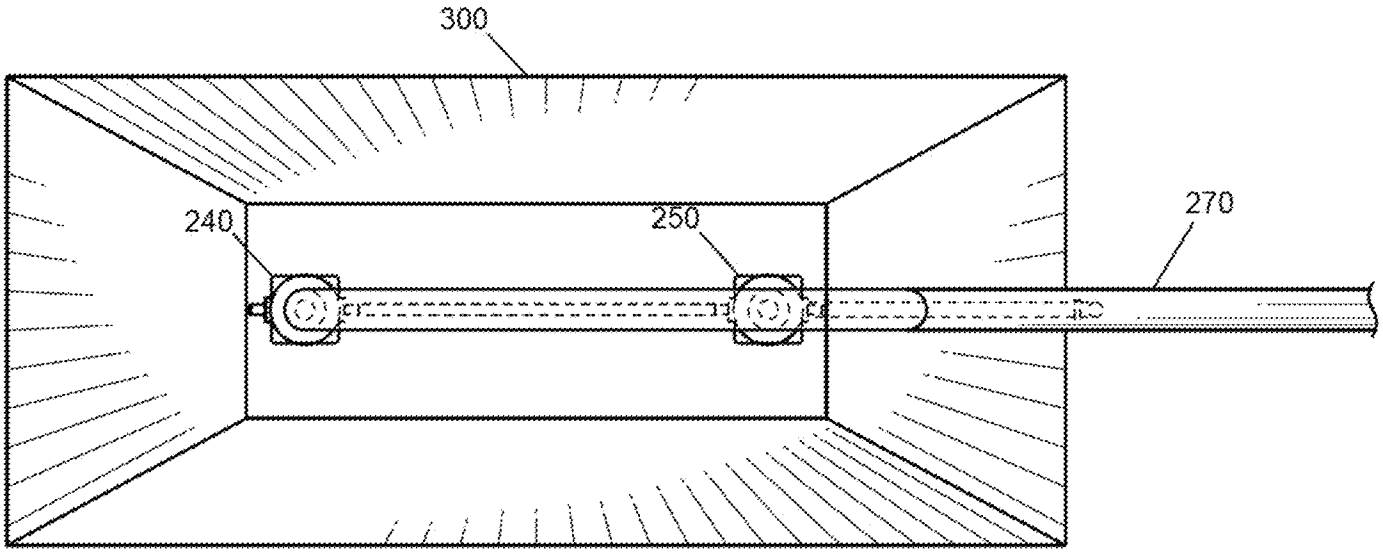
FIG. 18 is a top plan view of a dust hood according to an embodiment of the present disclosure.

In one embodiment, the method 500 may further involve supplying 550 compressed air to one or more air amplifiers 240, 250 connected to the dust hood 300 from one or more compressed air sources 260 thereby to create a vacuum in the dust hood 300. FIG. 18 illustrates a top plan view of the dust hood 300 showing the one or more air amplifiers 240, 250 connected to the dust hood 300 according to an embodiment of the present disclosure. The air and the generated silica dust may be drawn under vacuum pressure from the regions underlying the dust hood 300 and overlying the blender hopper 110 and recirculated from the one or more outlets 310, 320 of the dust hood 300 to the one or more proppant silos 150 via one or more vacuum hoses 270.

In another embodiment, the method 500 may further involve directing 570 sand proppant P from the blender hopper 110 to a blender 130 via an augur 120 having an end thereof positioned to underlie the blender hopper 110 and thereby to blend sand proppant P prior to injection of blended sand proppant under pressure down into a hydrocarbon well located at the hydrocarbon well site.

Figure 16:
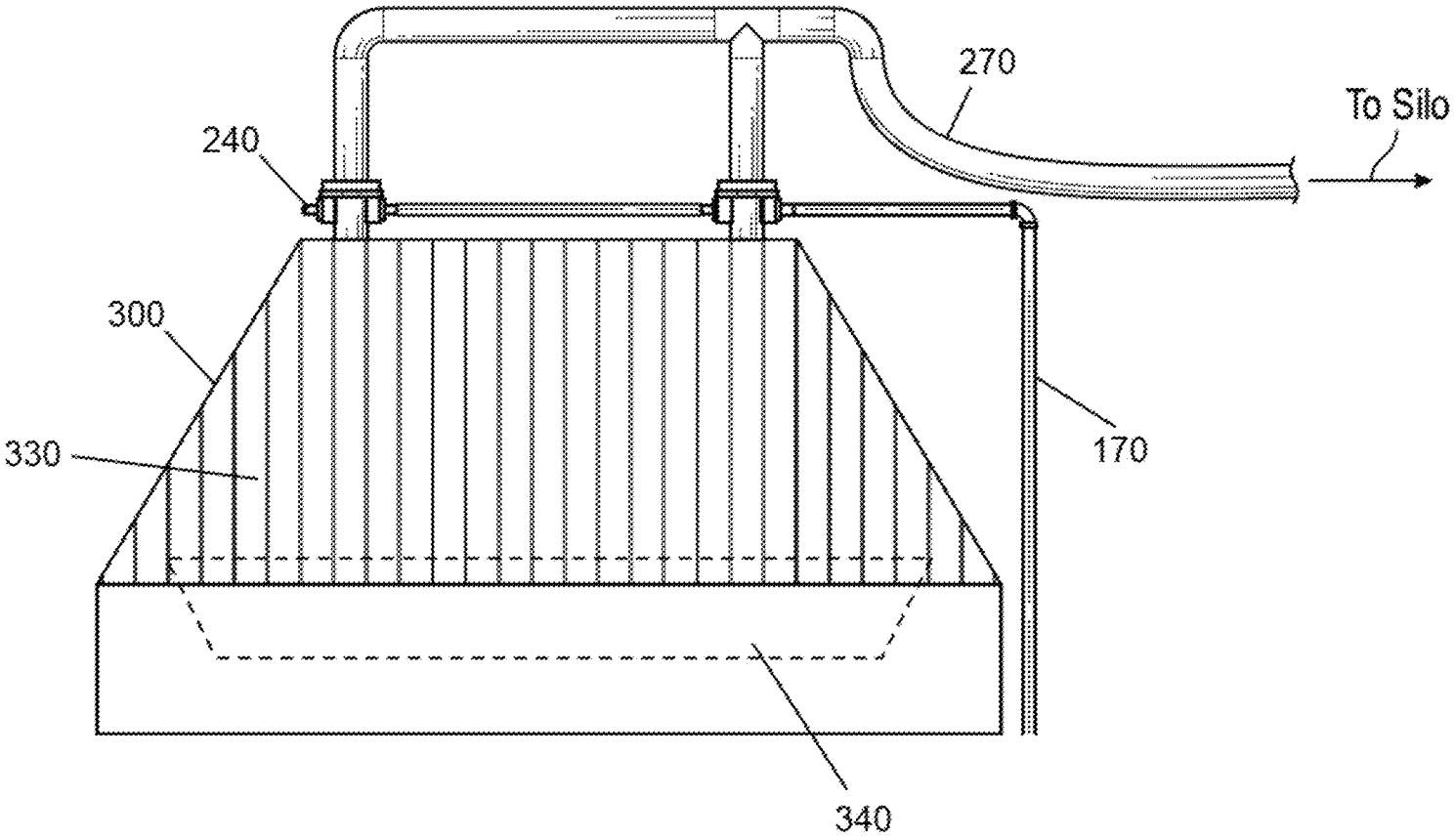
FIG. 16 is a front elevational view of a dust hood according to an embodiment of the present disclosure.

In one embodiment, the dust hood 300 may have a shielded curtain 330 positioned adjacent the distal end portion of the conveyor 180 from which sand proppant P is being fed into the blender hopper 110 as illustrated in FIG. 16. FIG. 16 shows a front elevational view of the dust hood 300 with the shielded curtain 330 positioned adjacent the distal end portion of the conveyor 180 from which sand proppant P is being fed into the blender hopper 110 according to an embodiment of the present disclosure. The shielded curtain 330 may be formed of a transparent or translucent material to allow viewing therethrough during operation in a region under the dust hood 300 and into the blender hopper 110 and without opening the shielded curtain 330.

According to an embodiment of the present disclosure, the shielded curtain may include a plurality of vertically hanging strips and being formed of a flexible material positioned as a cover for the opening 340 of the dust hood 300 to thereby retain air and the silica dust within the dust hood 300.

As illustrated in FIGS. 12-14, embodiments of the one or more vacuum hoses 270 may be connected to a sand silo filter arrangement 160 positioned in an upper portion of each of the one or more sand proppant silos 150 to provide enhance filtering of the silica dust before the silica dust to be supplied again for conveyance on the conveyor 180.

Shown in FIGS. 10-11 are the one or more air amplifiers 240, 250. Each of the one or more air amplifiers 240, 250 may include a transvector jet arrangement to enhance drawings of the compressed air and the generated silica dust in the dust hood and thereby to remove the silica dust under vacuum pressure from the one or more outlets of the dust hood.

The present application is a non-provisional application which claims priority to, and the benefit of U.S. Provisional Application No. 62/819,721, titled "SILICA DUST MITIGATION AND RECIRCULATION SYSTEM AND ASSOCIATED METHODS," filed Mar. 18, 2019, which is incorporated herein by reference in its entirety.

It should be understood that the order of activity as depicted in the figures above are conceptual and may deviate without departing from the various embodiments disclosed. Moreover, the specification and drawings are, accordingly, to be regarded in an illustrative rather than a restrictive sense. It will, however, be evident that various modifications and changes may be made thereunto without departing from the broader spirit and scope of the disclosure. While different embodiments of the disclosure, including apparatuses, systems, and methods, have been shown or described in only some of its forms, it should be apparent to those skilled in the art that the disclosure is not so limited, but is susceptible to various changes without departing from the scope of the disclosure. Furthermore, it is to be understood that the above disclosed embodiments are merely illustrative of the principles and applications of the present disclosure. Accordingly, numerous modifications may be made to the illustrative embodiments and other arrangements may be devised without departing from the spirit and scope of the present disclosure.

That claimed is:

1. A silica dust mitigation and recirculation system for a hydrocarbon well site, the system comprising:

a blender hopper positioned at the hydrocarbon well site and positioned to receive sand proppant;

one or more proppant silos positioned at a selected distance from the blender hopper at the hydrocarbon well site and having an interior chamber to store sand proppant therein;

a footed hood configured to be positioned to overlie the blender hopper, the footed hood including a main hood portion having one or more outlets to provide a fluid outlet path from the footed hood to the one or more proppant silos;

a conveyor having a proximal end portion and a distal end portion, the proximal end portion being positioned adjacent a lower portion of the one or more proppant silos and the distal end portion being positioned adjacent a lower portion of the footed hood and positioned to feed sand proppant to the blender hopper;

one or more air amplifiers connected to the main hood portion of the footed hood to amplify air adjacent the one or more outlets of the main hood portion of the footed hood and thereby enhance drawing of air and generated silica dust in regions underlying the footed hood and overlying the blender hopper by vacuum pressure through the one or more outlets of the main hood portion of the footed hood;

one or more compressed air sources positioned to provide compressed air to the one or more air amplifiers; and one or more vacuum hoses in fluid communication with the one or more outlets of the main hood portion of the footed hood and extending away therefrom to the one or more sand proppant silos to provide a path for the generated silica dust from the footed hood to the one or more sand proppant silos, the generated silica dust being removed from regions overlying the blender hopper and fluidly recirculated to the one or more sand proppant silos for storage therein and to be supplied once again for conveyance on the conveyor.

2. The system as defined in claim 1, wherein the conveyor conveys sand proppant thereon from the one or more proppant silos to the blender hopper through an opening adjacent the lower portion of the footed hood and feeds sand proppant to an augur having an end thereof positioned to underlie the blender hopper so that the augur transfers sand proppant being fed thereto further to a blender positioned on a back of a truck thereby to blend sand proppant prior to injection of blended sand proppant under pressure down into a hydrocarbon well located at the hydrocarbon well site.

3. The system as defined in claim 1, wherein the main hood portion further comprises a main hood body having a shielded curtain portion positioned adjacent the distal end portion of the conveyor from which sand proppant is being conveyed into the blender hopper, the shielded curtain portion being transparent or translucent to allow viewing therethrough during operation in a region under the main hood portion and into the blender hopper.

4. The system as defined in claim 1, wherein the footed hood further comprises a plurality of support legs connected to and extending downwardly from lower peripheries of the main hood portion and a plurality of feet each connected to a respective one of the plurality of support legs to enhance support for the footed hood on a support surface at the hydrocarbon well site.

5. The system as defined in claim 1, wherein the one or more vacuum hoses is connected to a sand silo filter arrangement positioned in an upper portion of each of the one or more sand proppant silos to enhance filtering of the silica dust.

6. The system as defined in claim 1, wherein the one or more vacuum hoses extend to the one or more proppant silos and connect in a region closely adjacent the one or more proppant silos thereafter to extend upwardly along a vertical extent of each of the one or more proppant silos to the sand silo filter arrangement positioned in the upper region of each of the one or more proppant silos.

7. The system as defined in claim 4, wherein each of the plurality of support legs of the footed hood further comprises two or more leg segments and a leg adjustment arrangement positioned to adjust the extent of at least one of the two or more support leg segments to thereby adjust the overall vertical extent of each of the plurality of support legs and thereby, in turn, to adjust overall height of the footed hood to a selected height so that the main hood portion overlies the blender hopper at a desired elevational location.

8. A silica dust mitigation and recirculation system for a hydrocarbon well site, the system comprising:

a footed hood configured to be positioned to overlie a blender hopper when positioned on a hydrocarbon well site, the blender hopper positioned to receive sand proppant from a conveyor when positioned so that conveyor feeds sand proppant thereto, passes sand proppant through the blender hopper, and feeds sand proppant to an augur so that the augur transfers sand proppant being fed thereto to a blender thereby to blend sand proppant prior to injection of blended sand proppant under pressure down into a hydrocarbon well located at the hydrocarbon well site, the footed hood having a main hood portion, a plurality of support legs connected to and extending downwardly from lower peripheries of the main hood portion, and a plurality of feet each connected to a respective one of the plurality of legs to enhance support for the footed hood on a support surface at the well site, the main hood portion being positioned to overlie upper peripheries of the blender hopper, and the plurality of support legs extend downwardly so that each of the plurality of feet contact the underlying support surface thereby to enhance support of the footed hood on the underlying support surface, the footed hood further including one or more outlets positioned in an upper region of the main hood portion to provide a fluid outlet path from the footed hood;

one or more air amplifiers in fluid communication with the one or more outlets of the footed hood and connected to the footed hood to amplify air being supplied adjacent the one or more outlets being supplied from one or more compressed air sources and thereby enhance drawing of air and associated silica dust by vacuum pressure from the one or more outlets and from the footed hood, the silica dust being generated in a location underlying the footed hood and overlying the blender hopper when sand proppant from the conveyor is being conveyed into the blender hopper; and one or more vacuum hoses connected to an outlet of the one or more air amplifiers and in fluid communication therewith to provide a fluid flow path under vacuum pressure from the one or more air amplifiers and extending away therefrom to one or more sand proppant silos each of which stores sand proppant therein when positioned at the hydrocarbon well site, the one or more vacuum hoses further extending and connecting to a sand silo filter arrangement positioned in an upper portion of each of the one or more sand proppant silos to enhance filtering of sand proppant and so that silica dust being fluidly supplied under vacuum pressure from the one or more outlets of the footed hood and through the one or more vacuum hoses recirculates to the sand proppant silo for storage therein to be supplied once again for conveyance on the conveyor thereby to provide a silica dust removal and re-circulation path for the silica dust when generated in regions overlying the blender hopper.

9. The system as defined in claim 8, wherein each of the plurality of legs of the footed hood comprises two or more leg segments and a leg adjustment arrangement positioned to adjust the extent of at least one of the two or more leg segment to thereby adjust the overall vertical extent of each of the plurality of legs and thereby, in turn, to adjust overall height of the footed hood to a selected height so that the main hood portion overlies the blender hopper at a desired elevational location.

10. The system as defined in claim 8, wherein the one or more vacuum hoses extends to the one or more proppant silos and connects in a region closely adjacent the one or more proppant silos thereafter to extend upwardly along a vertical extent of the one or more proppant silos to the filter arrangement positioned in an upper region of the one or more proppant silos.

11. The system as defined in claim 8, wherein the main hood portion comprises a main hood body having a shielded curtain portion positioned adjacent an end of the conveyor from which sand proppant is being fed into the blender hopper, the shielded curtain portion being formed of a material to allow viewing therethrough during operation in a region under the main hood portion and into the blender hopper when a system operator is positioned adjacent thereto.

12. The system as defined in claim 8, further comprising one or more air hoses connected to and in fluid communication with the one or more air amplifiers and an air compressor positioned to supply compressed air to the one or more air hoses, and wherein each of the one or more air amplifiers comprises a transvector jet arrangement.

13. A footed hood configured to be positioned to overlie a blender hopper for mitigating silica dust at a hydrocarbon well site, the footed hood comprising:

a main hood portion having one or more outlets to provide a fluid outlet path from the footed hood to one or more proppant silos positioned at a selected distance from the blender hopper;

a main hood body having an opening adjacent an end of a conveyor from which sand proppant is being fed into the blender hopper;

a shielded curtain portion being formed of a transparent or translucent material to allow viewing therethrough and without opening the shielded curtain portion during operation, the shielded curtain portion being positioned as a cover for the opening of the main hood body to thereby retain air and the silica dust within the footed hood;

a plurality of support legs connected to and extending downwardly from lower peripheries of the main hood portion; and a plurality of feet each connected to a respective one of the plurality of support legs to enhance support for the footed hood on a support surface at the hydrocarbon well site.

14. The footed hood as defined in claim 13, wherein the shielded curtain portion comprising:

a plurality of vertically hanging strips being flexible and being formed of a transparent or translucent material to allow viewing therethrough, each of the plurality of the vertically hanging strips having a pair of horizontal short edges separated by a selected vertical dimension, the selected vertical dimension defining a length of each of the plurality of vertically hanging strips to span the opening of the main hood body of the footed hood, each of the plurality of vertically hanging strips having a pair of vertical long edges separated by a selected horizontal dimension, and the selected horizontal dimension defining a width of each of the plurality of vertically hanging strips, and the length and the width defining an area of each of the plurality of vertically hanging strips.

15. The footed hood as defined in claim 14, wherein the pair of horizontal short edges of each of the plurality of vertically hanging strips comprises a proximal short edge portion and a distal short edge portion, the proximal short edge portion being suspended from adjacent an edge of the main hood portion, the distal short edge portion being terminated adjacent a lower region of the main hood body of the footed hood to substantially cover height of the opening, and each of the plurality of vertically hanging strips overlapping one another to partially cover the opening into which the end of the conveyor enters the main hood body of the footed hood.

16. The footed hood as defined in claim 13, wherein each of the plurality of support legs of the footed hood further comprises two or more leg segments and a leg adjustment arrangement positioned to adjust the extent of at least one of the two or more support leg segments to thereby adjust the overall vertical extent of each of the plurality of support legs and thereby, in turn, to adjust overall height of the footed hood to a selected height so that the main hood portion overlies the blender hopper at a desired elevational location.

17. A method of mitigating and recirculating silica dust at a hydrocarbon well site, the method comprising:

conveying sand proppant on a conveyor from one or more proppant silos to a blender hopper positioned at the hydrocarbon well site through a footed hood positioned to overlie the blender hopper, the conveyor having a proximal end portion and a distal end portion, the proximal end portion being positioned adjacent lower portion of the one or more proppant silos and the distal end portion being positioned adjacent a lower portion of the footed hood and positioned to feed sand proppant to the blender hopper;

directing sand proppant from the conveyor into the blender hopper through an opening adjacent the lower portion of the footed hood to unload sand proppant from the conveyor into the blender hopper, the unloading of sand proppant generating silica dust in regions underlying the footed hood and overlying the blender hopper; and supplying compressed air to one or more air amplifiers connected to a main hood portion of the footed hood from one or more compressed air sources thereby to create a vacuum in the main hood portion of the footed hood, the air and the generated silica dust being drawn under vacuum pressure from the regions underlying the footed hood and overlying the blender hopper and recirculated from one or more outlets of the footed hood to the one or more proppant silos via one or more vacuum hoses.

18. The method of claim 17 further comprising:

directing sand proppant from the blender hopper to a blender via an augur having an end thereof positioned to underlie the blender hopper and thereby to blend sand proppant prior to injection of blended sand proppant under pressure down into a hydrocarbon well located at the hydrocarbon well site.

19. The method of claim 17, wherein the footed hood further comprises a plurality of support legs connected to and extending downwardly from lower peripheries of the main hood portion, and a plurality of feet each connected to a respective one of the plurality of support legs to enhance support for the footed hood on a support surface at the hydrocarbon well site, and each of the plurality of support legs of the footed hood comprises two or more leg segments.

20. The method of claim 19 further comprising:

adjusting the extent of at least one of the two or more leg segments and the leg adjustment arrangement to thereby adjust the overall vertical extent of each of the plurality of legs and thereby, in turn, to adjust overall height of the footed hood to a selected height so that the main hood portion overlies the blender hopper at a desired elevational location.

21. The method of claim 17, wherein the main hood portion comprises a main hood body having a shielded curtain portion positioned adjacent the distal end portion of the conveyor from which sand proppant is being fed into the blender hopper, the shielded curtain portion is transparent or translucent to allow viewing therethrough during operation in a region under the main hood portion and into the blender hopper.

22. The method of claim 17, wherein the one or more vacuum hoses connected to a sand silo filter arrangement positioned in an upper portion of each of the one or more sand proppant silos to provide enhance filtering of the silica dust before the silica dust to be supplied again for conveyance on the conveyor.

23. The method of claim 17, wherein each of the one or more air amplifiers comprises a transvector jet arrangement to enhance drawings of the compressed air and the generated silica dust in the footed hood and thereby to remove the silica dust under vacuum pressure from the one or more outlets of the footed hood.

24. A method of mitigating and recirculating silica dust at a hydrocarbon well site, the method comprising:

conveying sand proppant on a conveyor from one or more proppant silos to a blender hopper positioned at the hydrocarbon well site through a dust hood positioned to overlie the blender hopper, the conveyor having a proximal end portion and a distal end portion, the proximal end portion being positioned adjacent lower portion of the one or more proppant silos and the distal end portion being positioned adjacent a lower portion of the dust hood and positioned to feed sand proppant to the blender hopper;

directing sand proppant from the conveyor into the blender hopper through an opening adjacent the lower portion of the dust hood to unload sand proppant from the conveyor into the blender hopper, the dust hood having one or more outlets to provide a fluid outlet path from the dust hood to the one or more proppant silos, the unloading of sand proppant generating silica dust in regions underlying the dust hood and overlying the blender hopper;

supplying compressed air to one or more air amplifiers connected to the dust hood from one or more compressed air sources thereby to create a vacuum in the dust hood, the air and the generated silica dust being drawn under vacuum pressure from the regions underlying the dust hood and overlying the blender hopper and recirculated from the one or more outlets of the dust hood to the one or more proppant silos via one or more vacuum hoses; and directing sand proppant from the blender hopper to a blender via an augur having an end thereof positioned to underlie the blender hopper and thereby to blend sand proppant prior to injection of blended sand proppant under pressure down into a hydrocarbon well located at the hydrocarbon well site.

25. The method of claim 24, wherein the dust hood having a shielded curtain positioned adjacent the distal end portion of the conveyor from which sand proppant is being fed into the blender hopper, the shielded curtain being formed of a transparent or translucent material to allow viewing therethrough during operation in a region under the dust hood and into the blender hopper and without opening the shielded curtain.

26. The method of claim 25, wherein the shielded curtain comprises a plurality of vertically hanging strips and being formed of a flexible material positioned as a cover for the opening of the dust hood to thereby retain air and the silica dust within the dust hood.

27. The method of claim 17, wherein the one or more vacuum hoses connected to a sand silo filter arrangement positioned in an upper portion of each of the one or more sand proppant silos to provide enhanced filtering of the silica dust before the silica dust to be supplied again for conveyance on the conveyor.

28. The method of claim 17, wherein each of the one or more air amplifiers comprises a transvector jet arrangement to enhance drawings of the compressed air and the generated silica dust in the dust hood and thereby to remove the silica dust under vacuum pressure from the one or more outlets of the dust hood.

* * * * *